US010833442B2

(12) United States Patent
Cheng

(10) Patent No.: US 10,833,442 B2
(45) Date of Patent: Nov. 10, 2020

(54) ELECTRICAL CONNECTOR WITH ALIGNED CONTACTING POINTS BETWEEN CPU AND PCB

(71) Applicants: FU DING PRECISION COMPONENT (SHEN ZHEN) CO., LTD., Shenzhen (CN); FOXCONN INTERCONNECT TECHNOLOGY LIMITED, Grand Cayman (KY)

(72) Inventor: Chih-Pi Cheng, New Taipei (TW)

(73) Assignees: FUDING PRECISION COMPONENTS (SHENZHEN) CO., LTD., Shenzhen (CN); FOXCONN INTERCONNECT TECHNOLOGY LIMITED, Grand Cayman (KY)

( * ) Notice: Subject to any disclaimer, the term of this patent is extended or adjusted under 35 U.S.C. 154(b) by 0 days.

(21) Appl. No.: 16/543,649

(22) Filed: Aug. 19, 2019

(65) Prior Publication Data

US 2020/0059028 A1 Feb. 20, 2020

Related U.S. Application Data

(60) Provisional application No. 62/719,537, filed on Aug. 17, 2018.

(51) Int. Cl.
*H01R 13/24* (2006.01)
*H01R 12/57* (2011.01)
(Continued)

(52) U.S. Cl.
CPC ..... *H01R 13/2464* (2013.01); *H01R 12/57* (2013.01); *H01R 12/585* (2013.01);
(Continued)

(58) Field of Classification Search
CPC .. H01R 13/2442; H01R 12/57; H01R 12/714; H01R 13/2435; H01R 12/716;
(Continued)

(56) References Cited

U.S. PATENT DOCUMENTS 6,315,621 B1 * 11/2001 Natori ..... H01R 13/2428 439/862
6,688,893 B1 * 2/2004 Huang ..... H01R 12/57 439/66

(Continued)

*Primary Examiner* — Edwin A. Leon
*Assistant Examiner* — Matthew T Dzierzynski
(74) *Attorney, Agent, or Firm* — Wei Te Chung; Ming Chieh Chang

(57) ABSTRACT

An electrical connector includes an insulative housing and a plurality of contacts retained in the housing. Each of the contacts includes a vertical main body with retaining structure thereon, a mounting section split from the bottom portion of the main body with a horizontal pad at the end, a first transverse section extending from the top portion of the main body in a first transverse direction, an upward section extending upward from one end of the transverse direction, a second transverse section extending from an upper end of the upward section in a second transverse direction opposite to the first transverse direction, a curved contacting section extending from the end of the second transverse section, and a downward tip section formed at a free end of the contact section.

16 Claims, 36 Drawing Sheets

(51) Int. Cl.

| | |
|---|---|
| ***H01R 12/71*** | (2011.01) |
| ***H01R 12/58*** | (2011.01) |
| ***H01R 13/26*** | (2006.01) |
| ***H01R 13/40*** | (2006.01) |
| ***H01R 43/02*** | (2006.01) |

(52) U.S. Cl.
CPC ..... *H01R 12/714* (2013.01); *H01R 12/716* (2013.01); *H01R 13/2442* (2013.01); *H01R 13/26* (2013.01); *H01R 13/40* (2013.01); *H01R 43/02* (2013.01)

(58) Field of Classification Search
CPC ..... H01R 13/41; H01R 13/2457; H01R 13/2492; H01R 13/40; H01R 12/52; H01R 12/7076; H01R 43/16; H01R 12/585
See application file for complete search history.

(56) References Cited

U.S. PATENT DOCUMENTS

| | | | | |
|---|---|---|---|---|
| 6,695,628 | B2 * | 2/2004 | Yeh | H01R 13/2442 439/83 |
| 6,851,986 | B2 * | 2/2005 | Zhao | H01R 13/2435 439/595 |
| 6,976,851 | B2 * | 12/2005 | Huang | H01R 13/2442 439/66 |
| 6,984,130 | B2 * | 1/2006 | Richter | H01R 13/2435 439/66 |
| 7,052,284 | B2 * | 5/2006 | Liao | H01R 13/2435 439/66 |
| 7,278,892 | B1 * | 10/2007 | Chien | H01R 13/2442 439/862 |
| 7,341,485 | B2 * | 3/2008 | Polnyi | H01R 13/2435 439/591 |
| 7,559,811 | B1 * | 7/2009 | Polnyi | H01R 4/4809 439/591 |
| 8,033,870 | B2 * | 10/2011 | Xie | H01R 12/57 439/660 |
| 8,096,836 | B2 * | 1/2012 | Cheng | H01R 13/2435 439/626 |
| 8,123,574 | B2 * | 2/2012 | Ma | H01R 13/2442 439/862 |
| 8,187,009 | B2 * | 5/2012 | Liao | H01R 12/57 439/83 |
| 8,708,716 | B1 * | 4/2014 | Ho | H01R 12/714 439/83 |
| 10,079,443 | B2 * | 9/2018 | Costello | H01R 13/2442 |
| 10,116,080 | B1 * | 10/2018 | Ju | H01R 12/52 |
| 10,148,023 | B1 * | 12/2018 | Ju | H01R 12/714 |
| 10,276,953 | B2 * | 4/2019 | Huang | H01R 12/57 |
| 2009/0253287 | A1 * | 10/2009 | Polnyi | H01R 13/2457 439/331 |
| 2011/0086558 | A1 * | 4/2011 | Cheng | H01R 13/03 439/886 |
| 2012/0196491 | A1 * | 8/2012 | Dai | H01R 12/73 439/709 |
| 2017/0365947 | A1 | 12/2017 | Costello et al. | |
| 2018/0331441 | A1 | 11/2018 | Huang et al. | |
| 2019/0140383 | A1 * | 5/2019 | Ju | H01R 12/7076 |

* cited by examiner

ELECTRICAL CONNECTOR WITH ALIGNED CONTACTING POINTS BETWEEN CPU AND PCB

FIELD OF THE INVENTION

The invention relates to the electrical connector assembly, particularly to the electrical connector connecting the electronic package to the printed circuit board.

DESCRIPTION OF RELATED ART

The traditional socket connecting the CPU with the PCB may generally have the contacting point (of the contacting section) with the CPU and the contact point (of the mounting pad) with the PCB offset from each other at least in either direction X or direction Y, thus jeopardizing the performance during high speed transmission.

It is desired to have the electrical connector having the corresponding contacting points with regard to both the CPU and the PCB aligned in the vertical direction.

SUMMARY OF THE INVENTION

An electrical connector includes an insulative housing and a plurality of contacts retained in the housing. Each of the contacts includes a vertical main body with retaining structure thereon, a mounting section split from the bottom portion of the main body with a horizontal pad at the end, a first transverse section extending from the top portion of the main body in a first transverse direction, an upward section extending upward from one end of the transverse direction, a second transverse section extending from an upper end of the upward section in a second transverse direction opposite to the first transverse direction, a curved contacting section extending from the end of the second transverse section, and a downward tip section formed at a free end of the contact section. A slot is formed in at least the first transverse section or further the upward section to receiving a portion of the contact when said contact is downwardly deflected by the CPU.

Other objects, advantages and novel features of the invention will become more apparent from the following detailed description when taken in conjunction with the accompanying drawings.

DETAILED DESCRIPTION OF THE PREFERRED EMBODIMENT

Figure 1A:
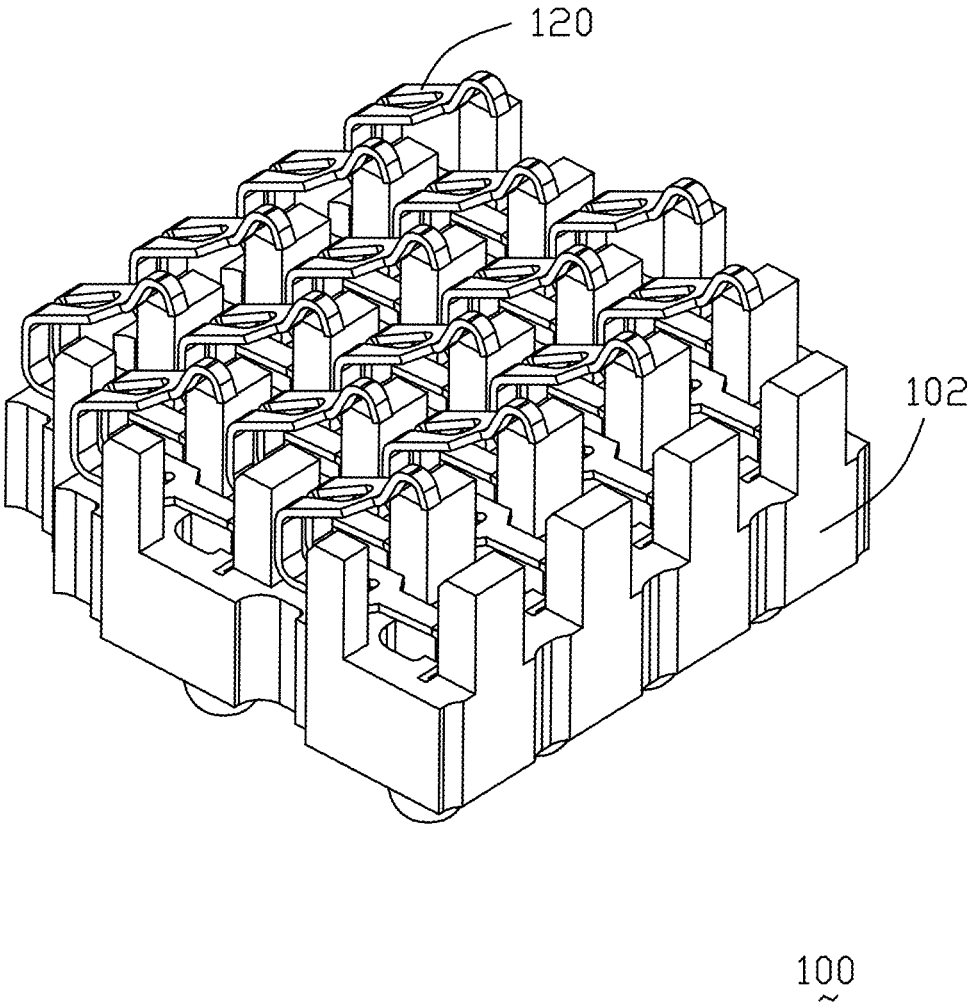
FIG. 1(A) is a downward perspective view of an electrical connector according to a first embodiment of the invention.
Figure 1B:
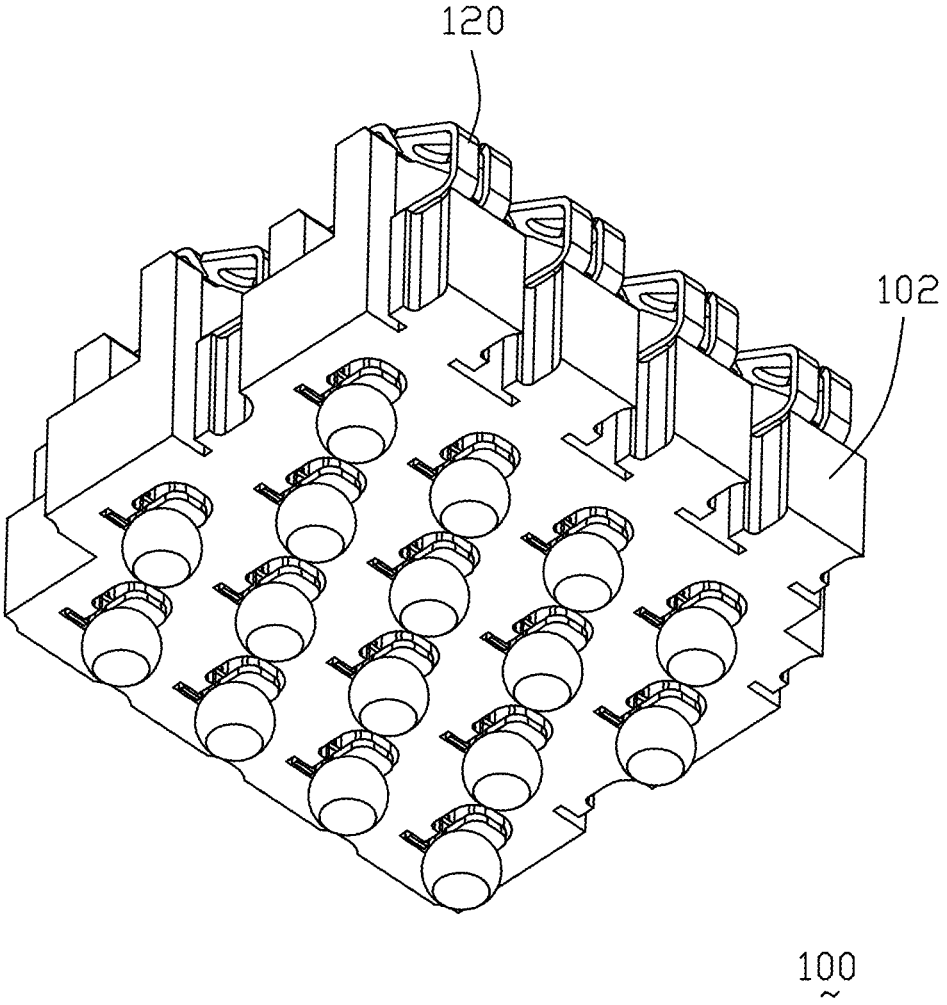
FIG. 1(B) is an upward perspective view of the electrical connector of FIG. 1(A)
Figure 2A:
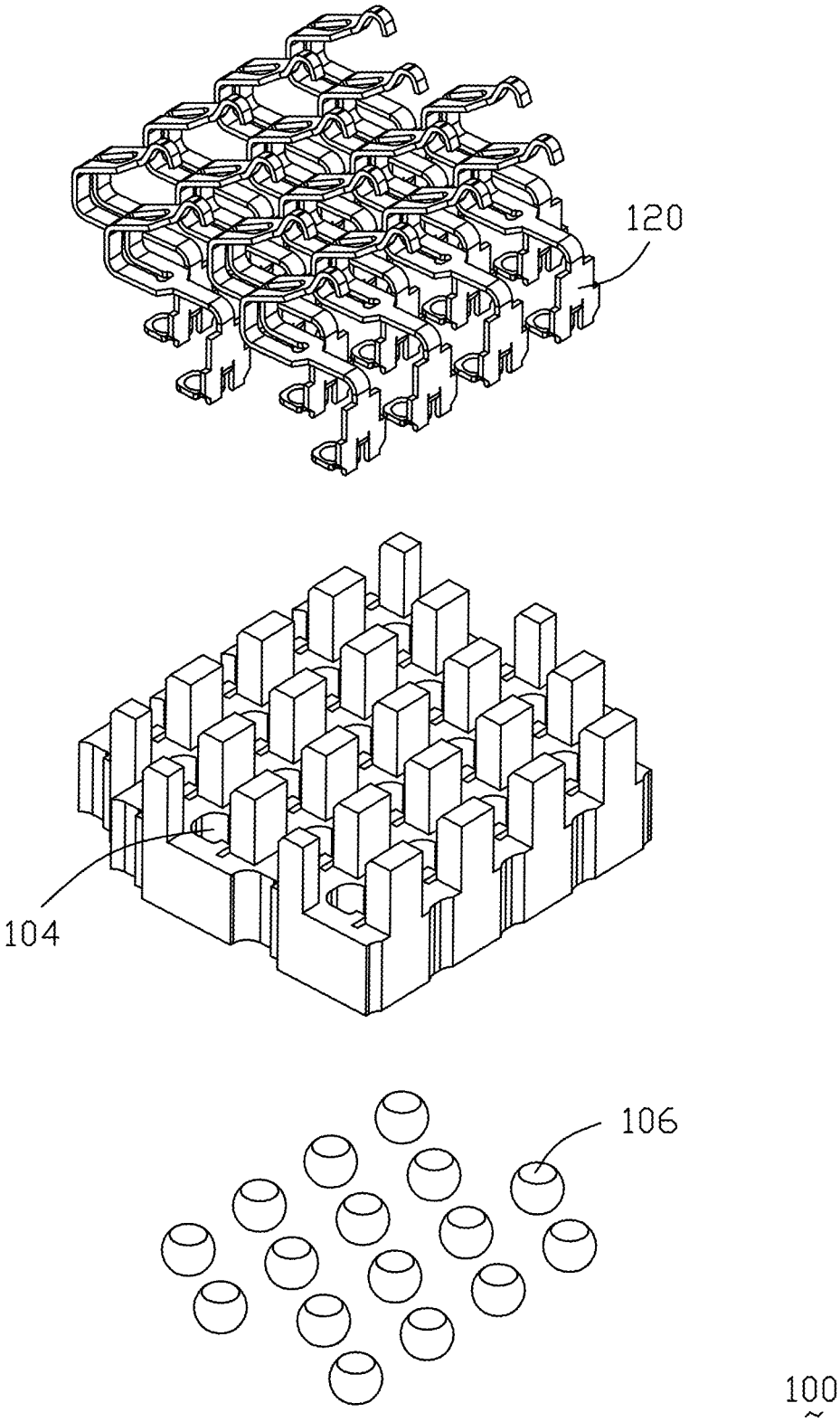
FIG. 2(A) is an downward exploded perspective view of the electrical connector of FIG. 1(A)
Figure 2B:
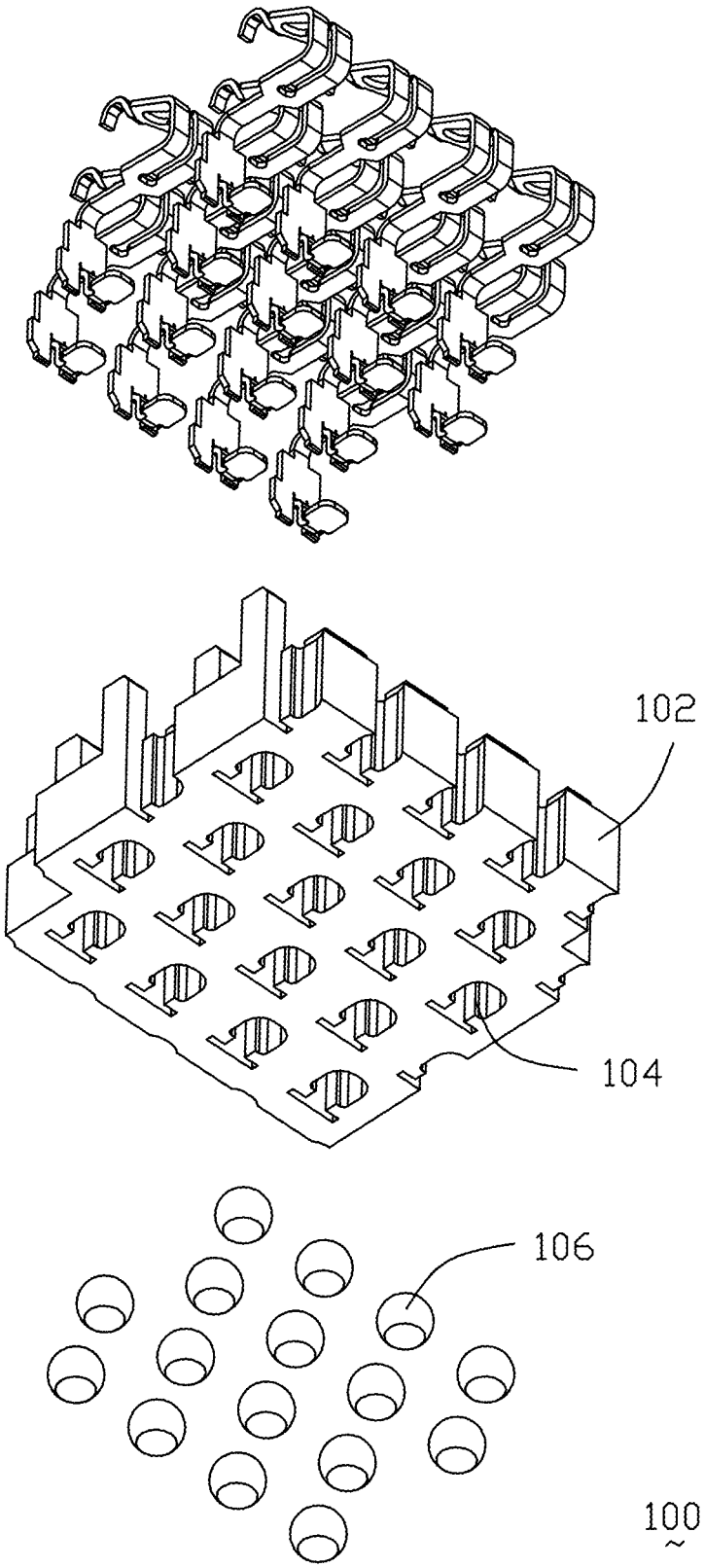
FIG. 2(B) is an upward exploded perspective view of the electrical connector of FIG. 1(B)
Figure 3A:
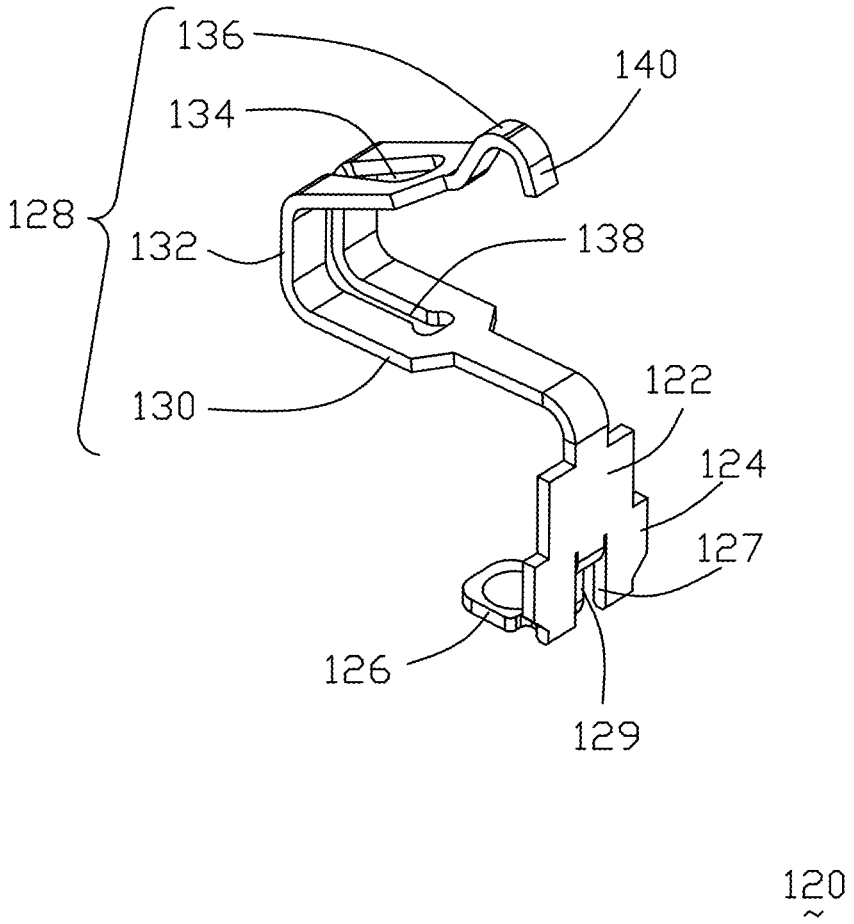
FIG. 3(A) is a downward perspective view of the contact of the electrical connector of FIG. 1(A)
Figure 3B:
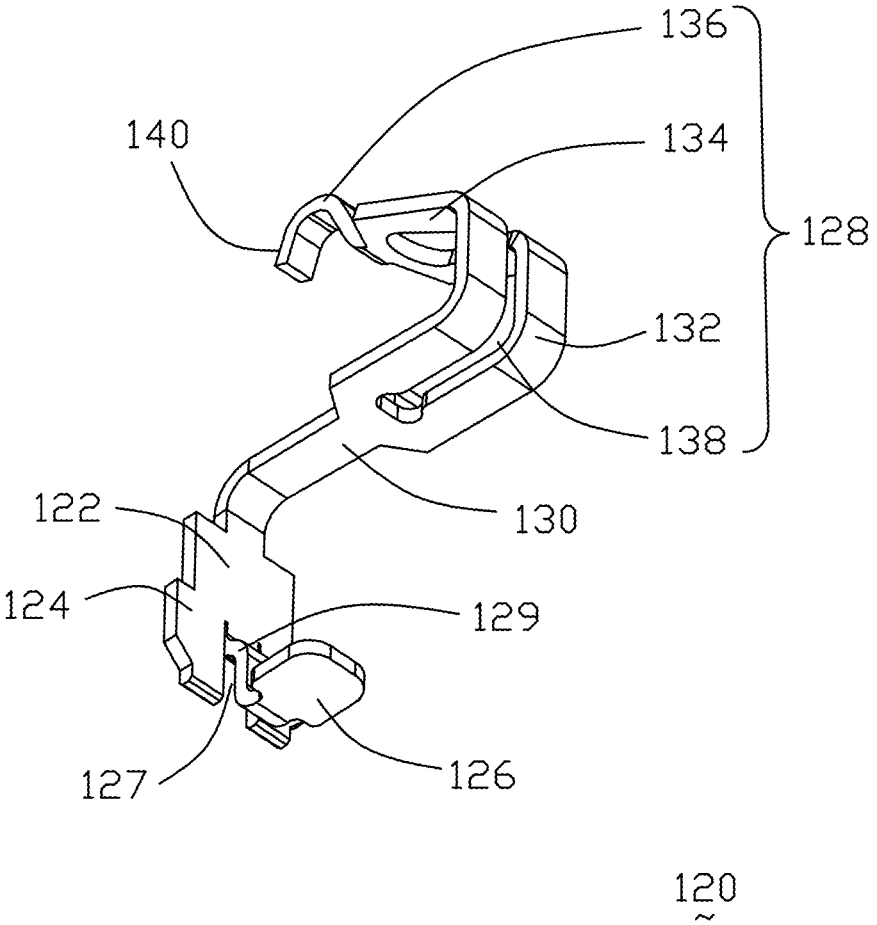
FIG. 3(B) is an upward perspective view of the contact of the electrical connector of FIG. 1(B)
Figure 4A:
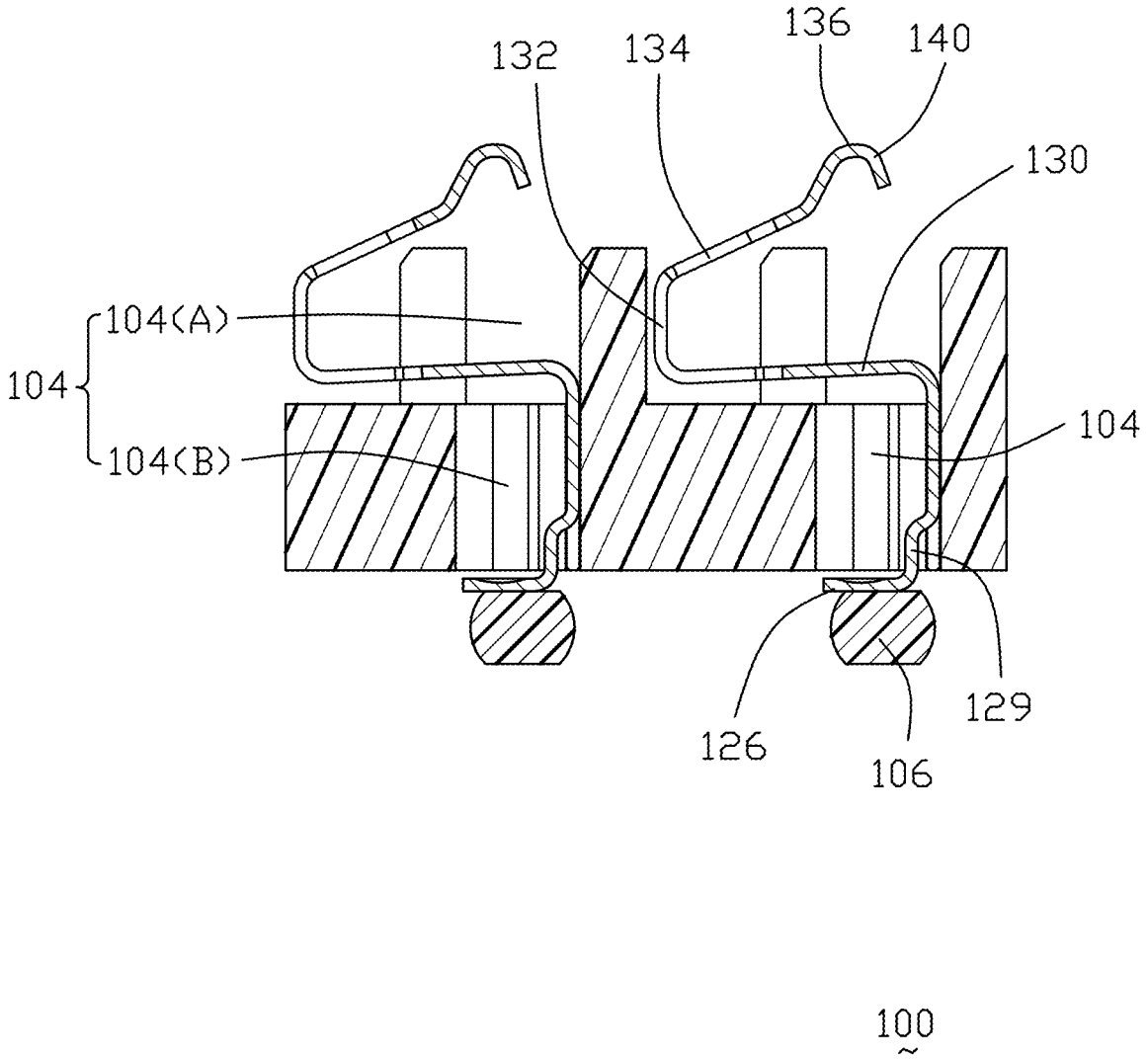
FIG. 4(A) is cross-sectional view of the electrical connector of FIG. 1(A) when the contact is not downwardly pressed by the CPU and soldered upon the PCB.
Figure 4B:
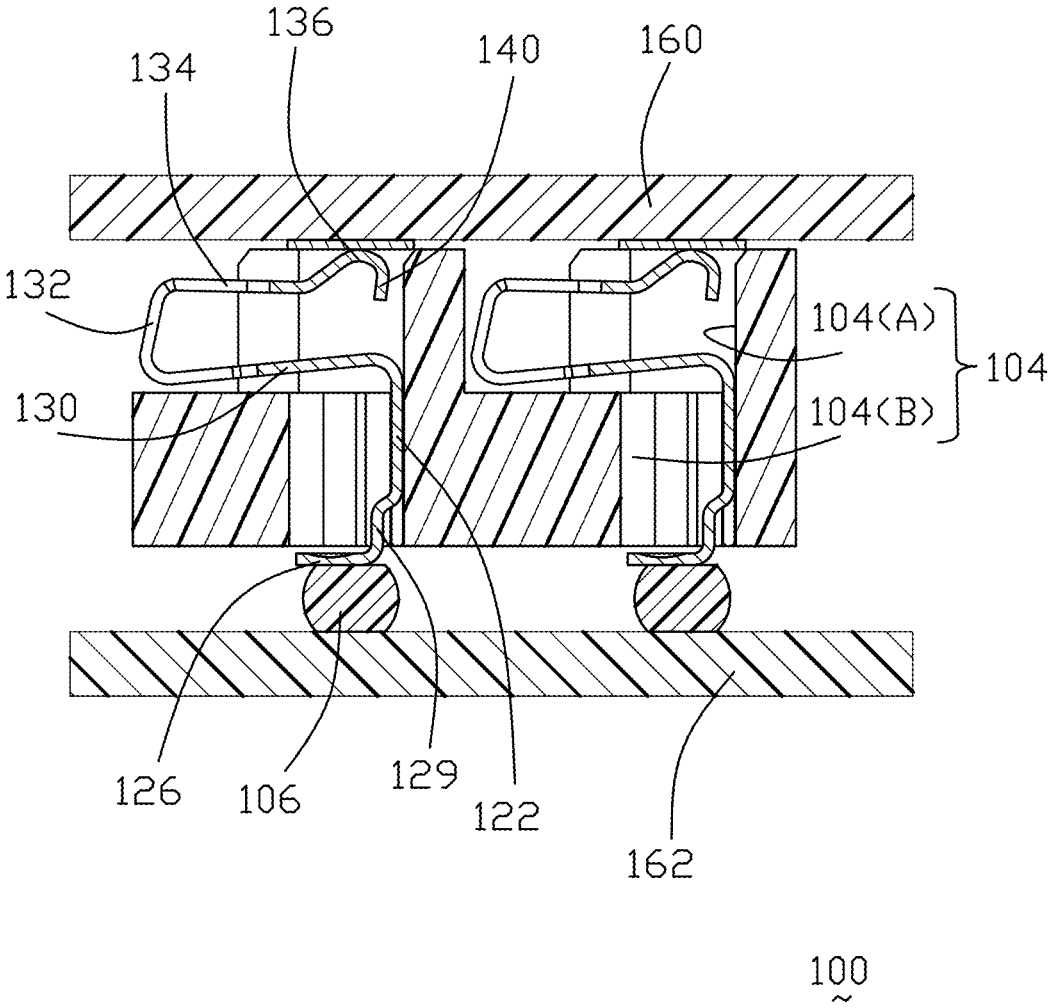
FIG. 4(B) is another cross-sectional view of the electrical connector of FIG. 1(A) when the connector is connected with both the CPU and the PCB and the contact is downwardly pressed.
Figure 5A:
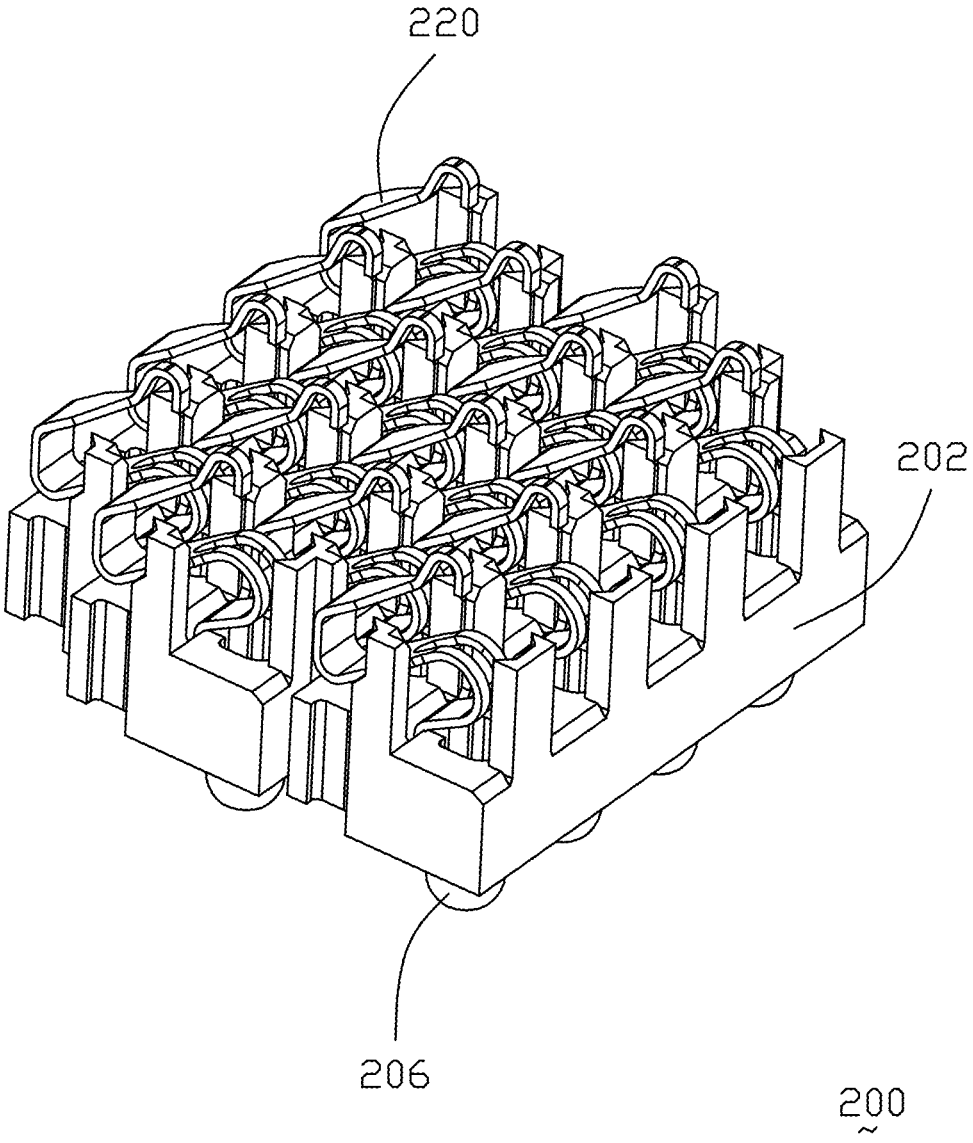
FIG. 5(A) is a downward perspective view of an electrical connector according to a second embodiment of the invention.
Figure 5B:
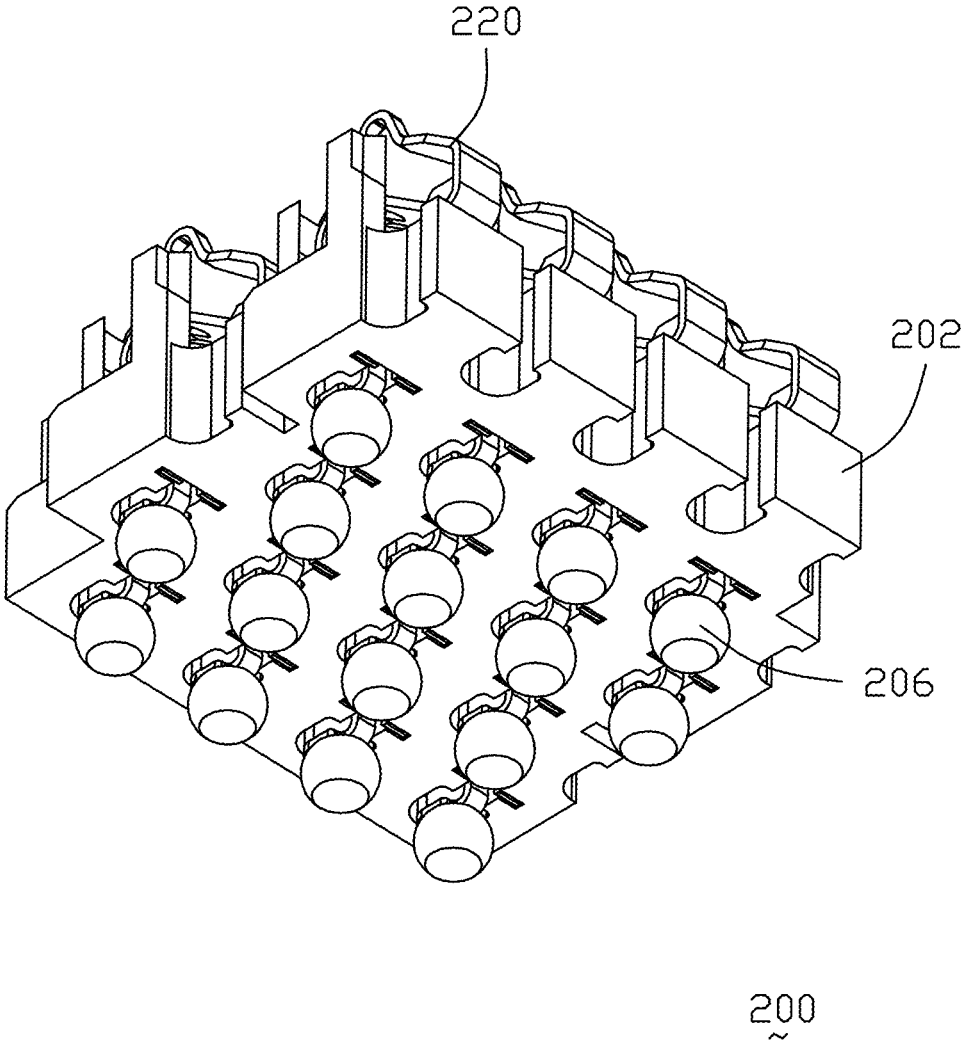
FIG. 5(B) is an upward perspective view of the electrical connector of FIG. 5(A)
Figure 6A:
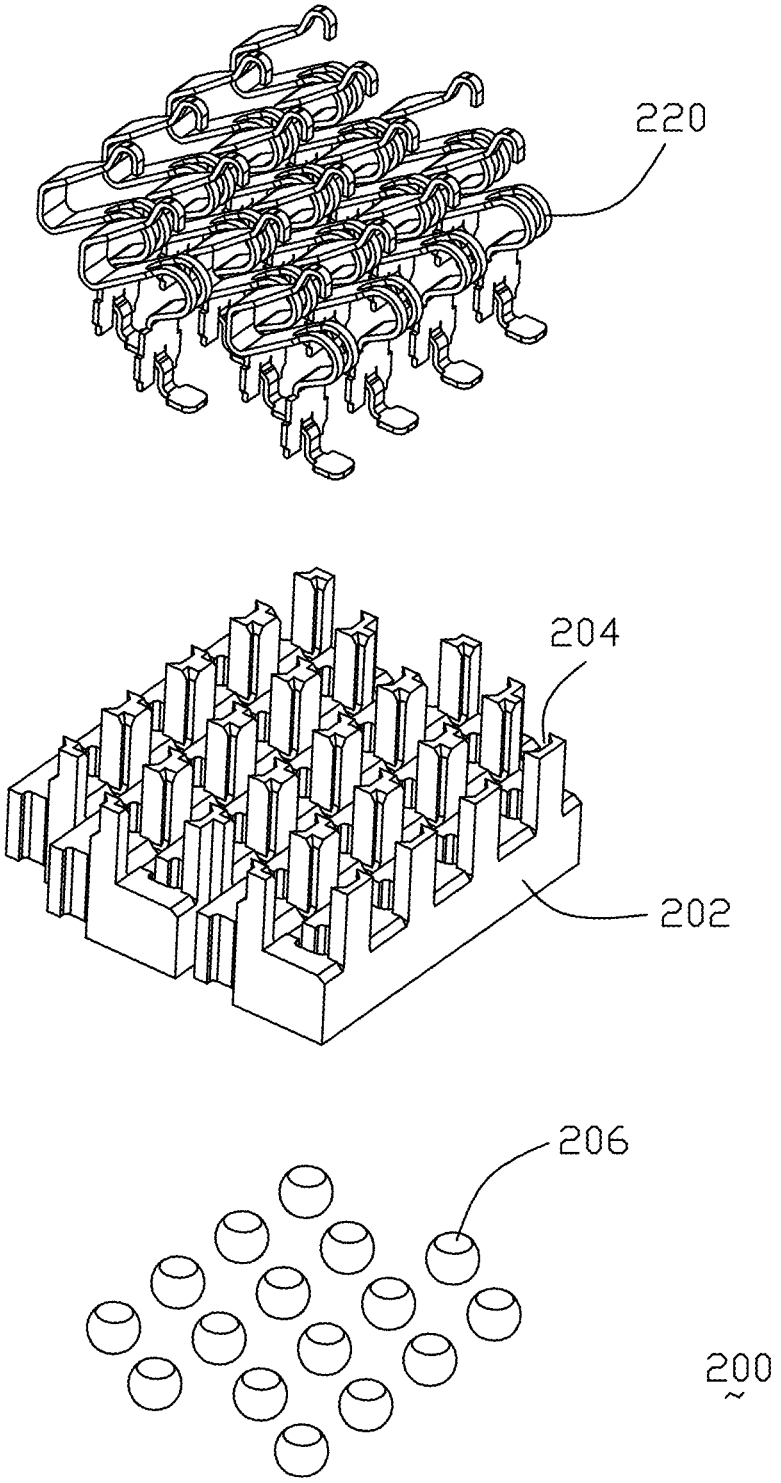
FIG. 6(A) is an downward exploded perspective view of the electrical connector of FIG. 5(A)
Figure 6B:
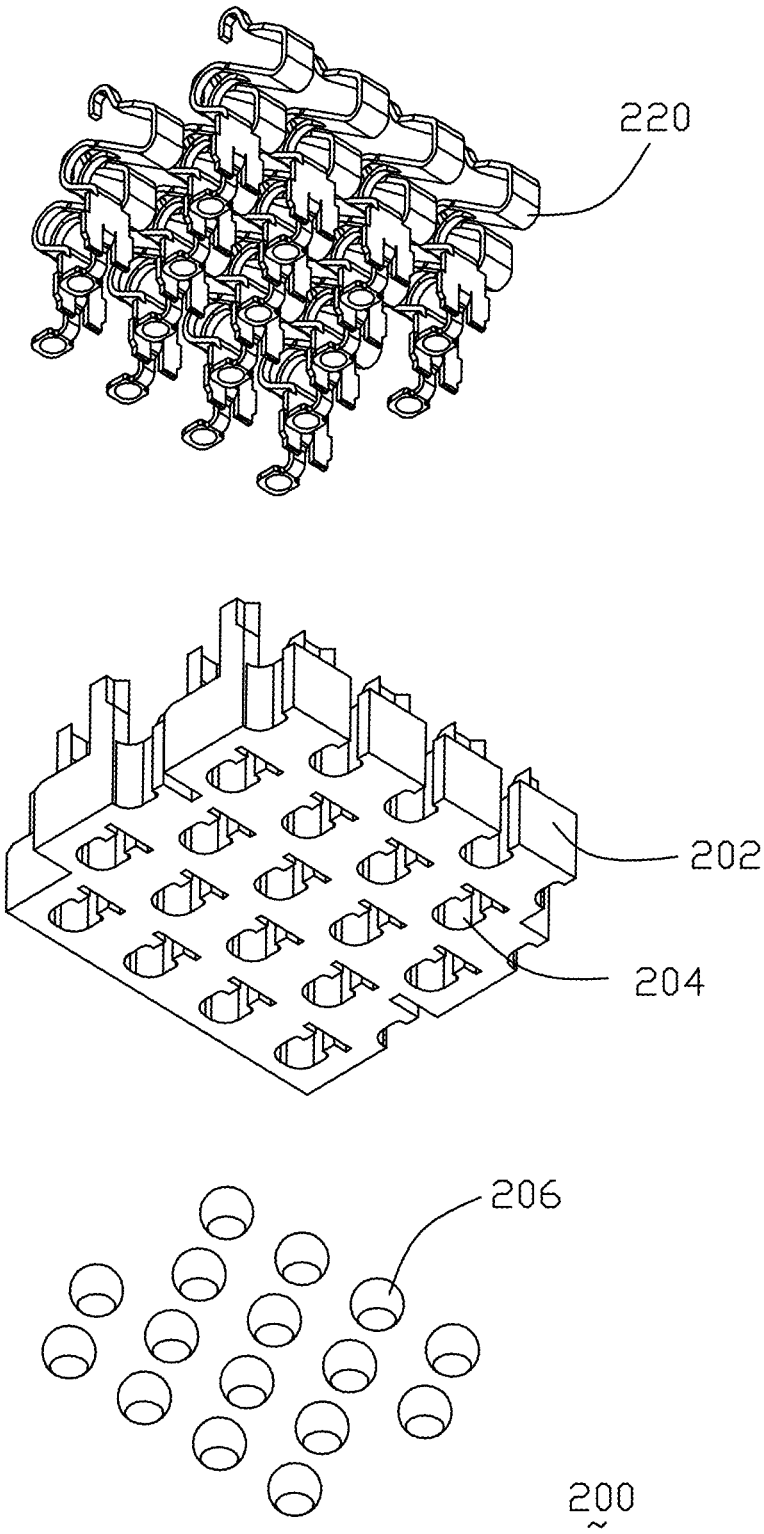
FIG. 6(B) is an upward exploded perspective view of the electrical connector of FIG. 5(B)
Figure 7A:
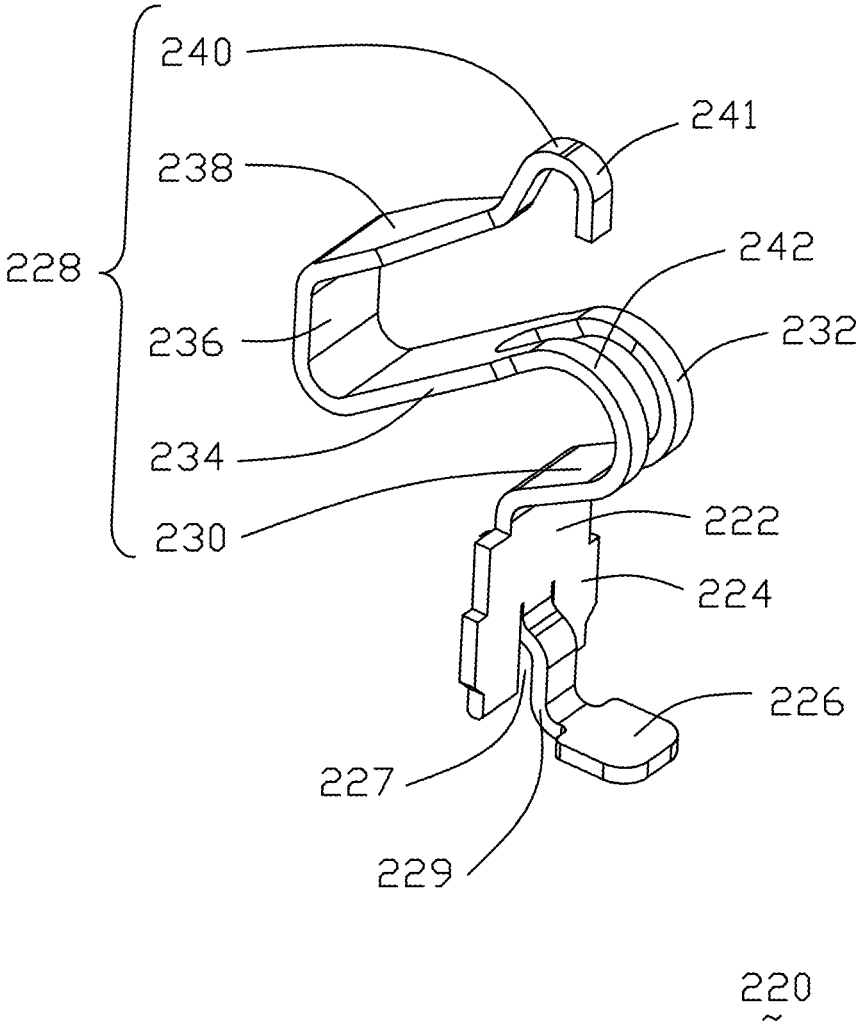
FIG. 7(A) is a downward perspective view of the contact of the electrical connector of FIG. 5(A)
Figure 7B:
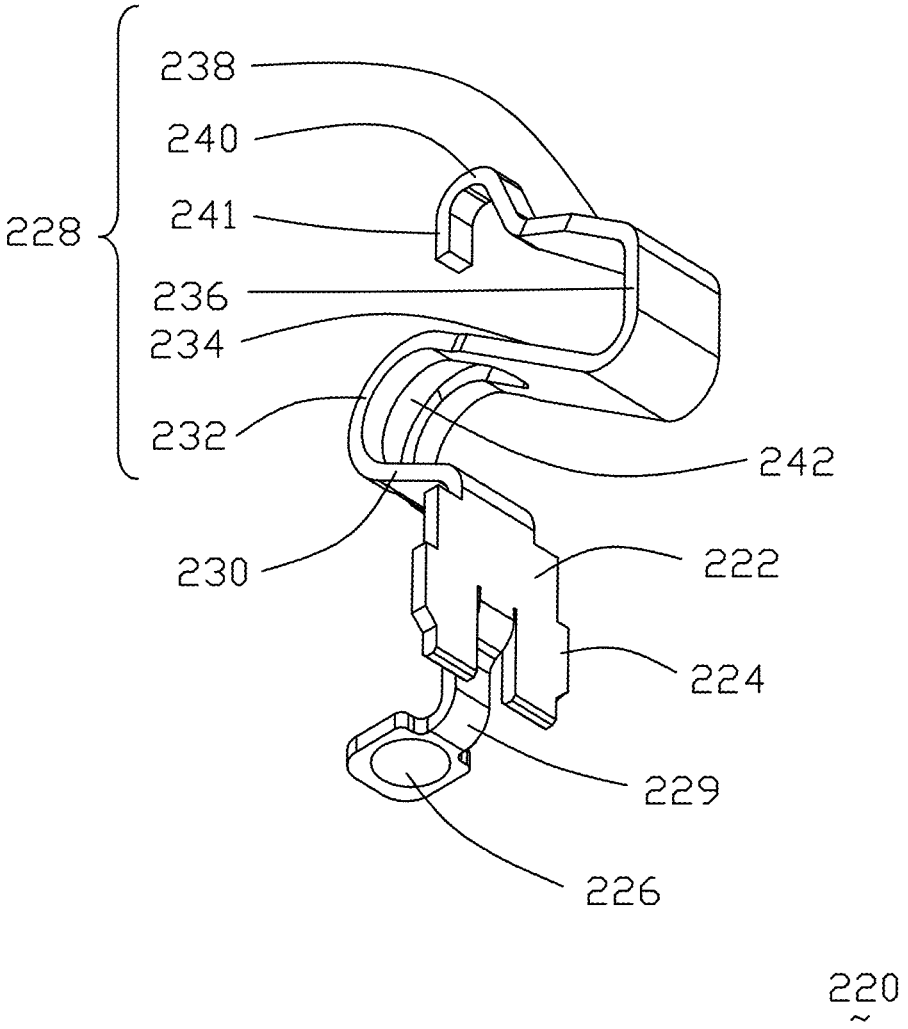
FIG. 7(B) is an upward perspective view of the contact of the electrical connector of FIG. 5(B)
Figure 8A:
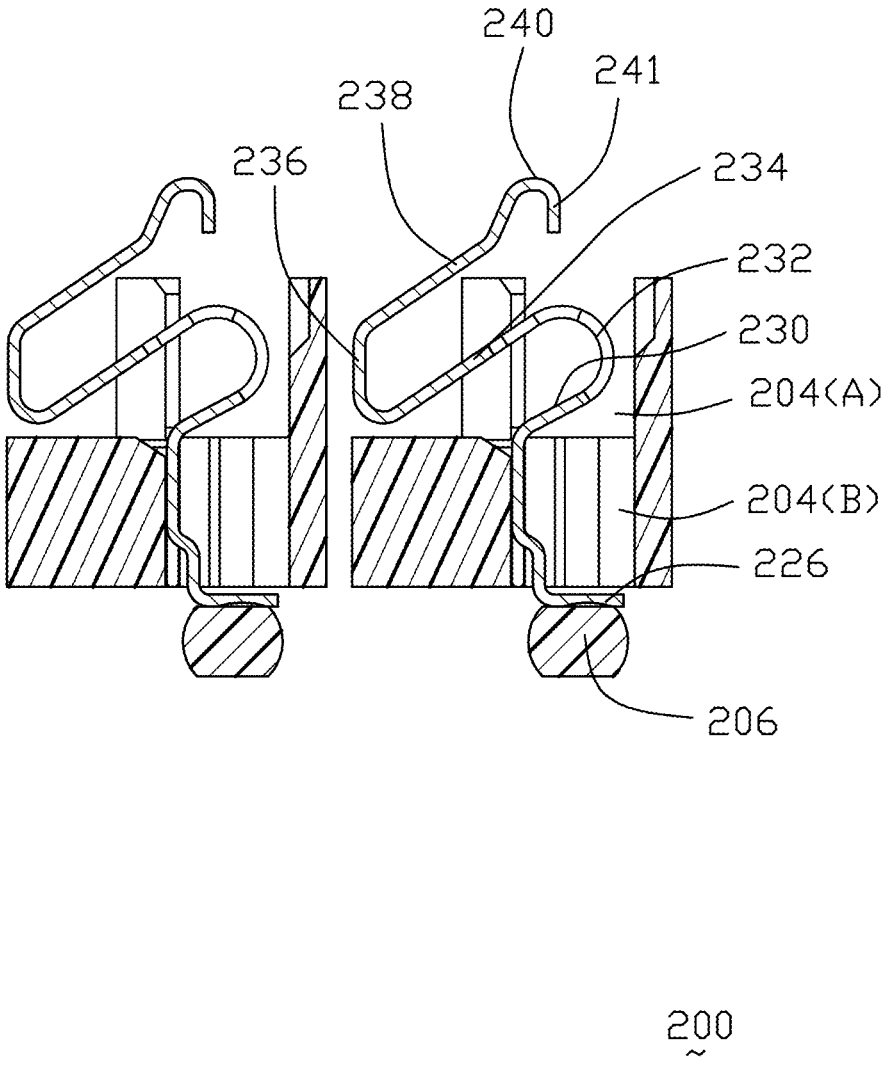
FIG. 8(A) is cross-sectional view of the electrical connector of FIG. 5(A) when the contact is not downwardly pressed by the CPU and soldered upon the PCB.
Figure 8B:
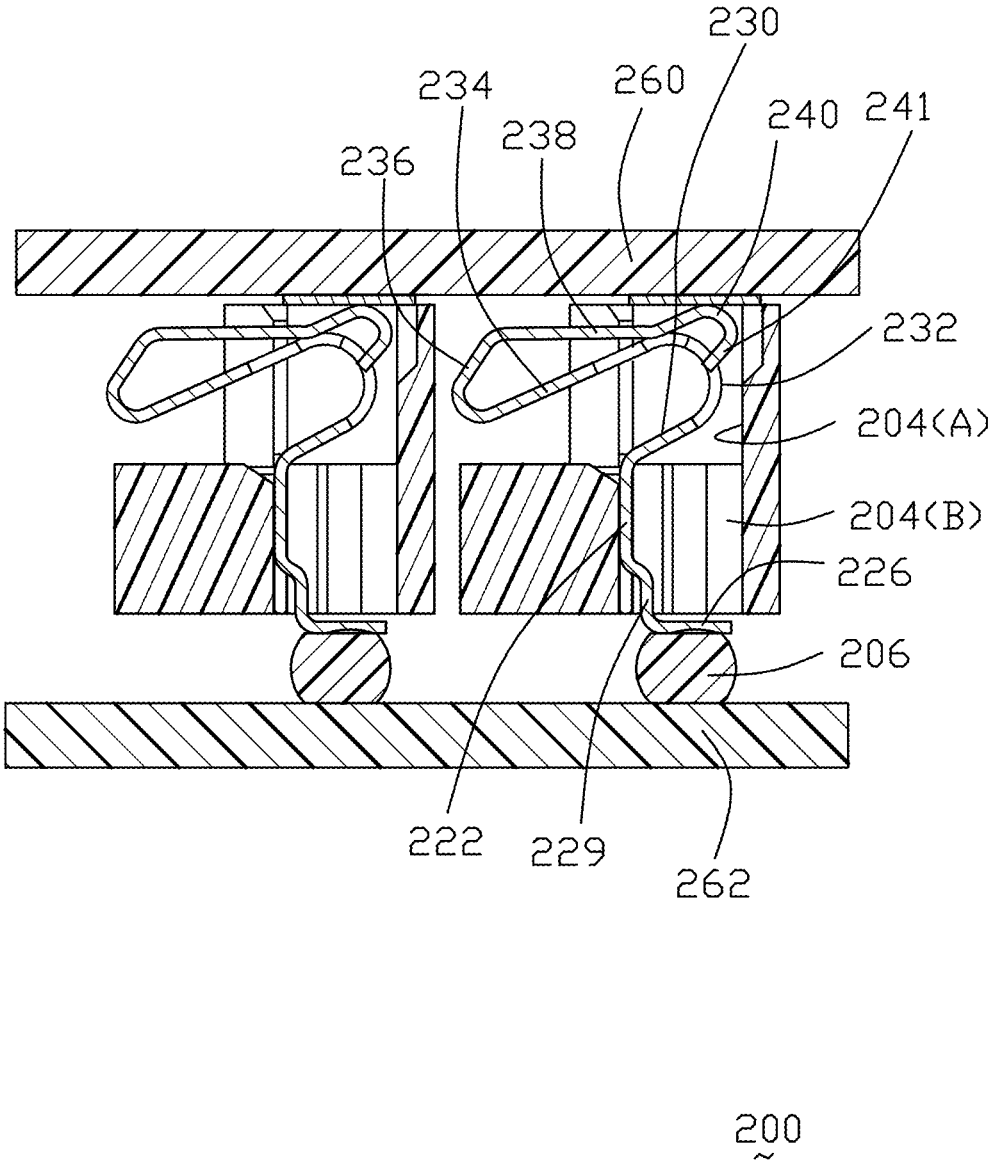
FIG. 8(B) is another cross-sectional view of the electrical connector of FIG. 5(A) when the connector is connected with both the CPU and the PCB and the contact is downwardly pressed.
Figure 9A:
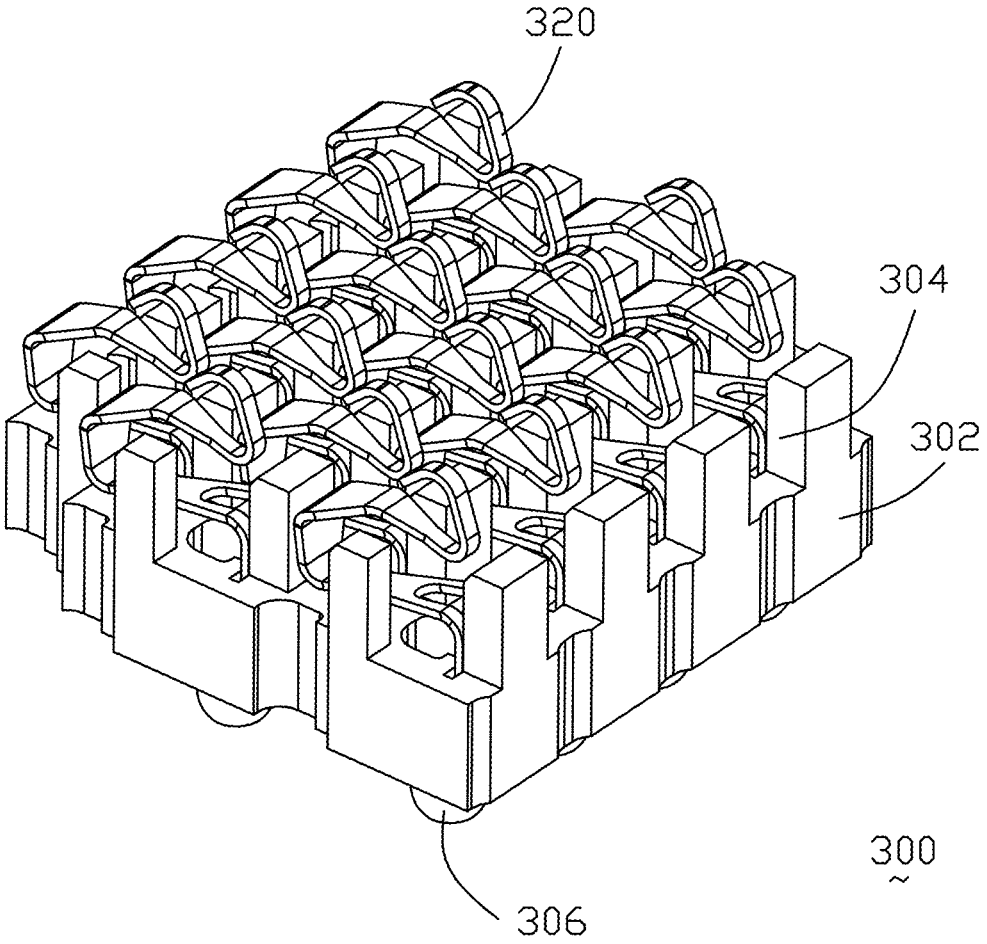
FIG. 9(A) is a downward perspective view of an electrical connector according to a third embodiment of the invention.
Figure 9B:
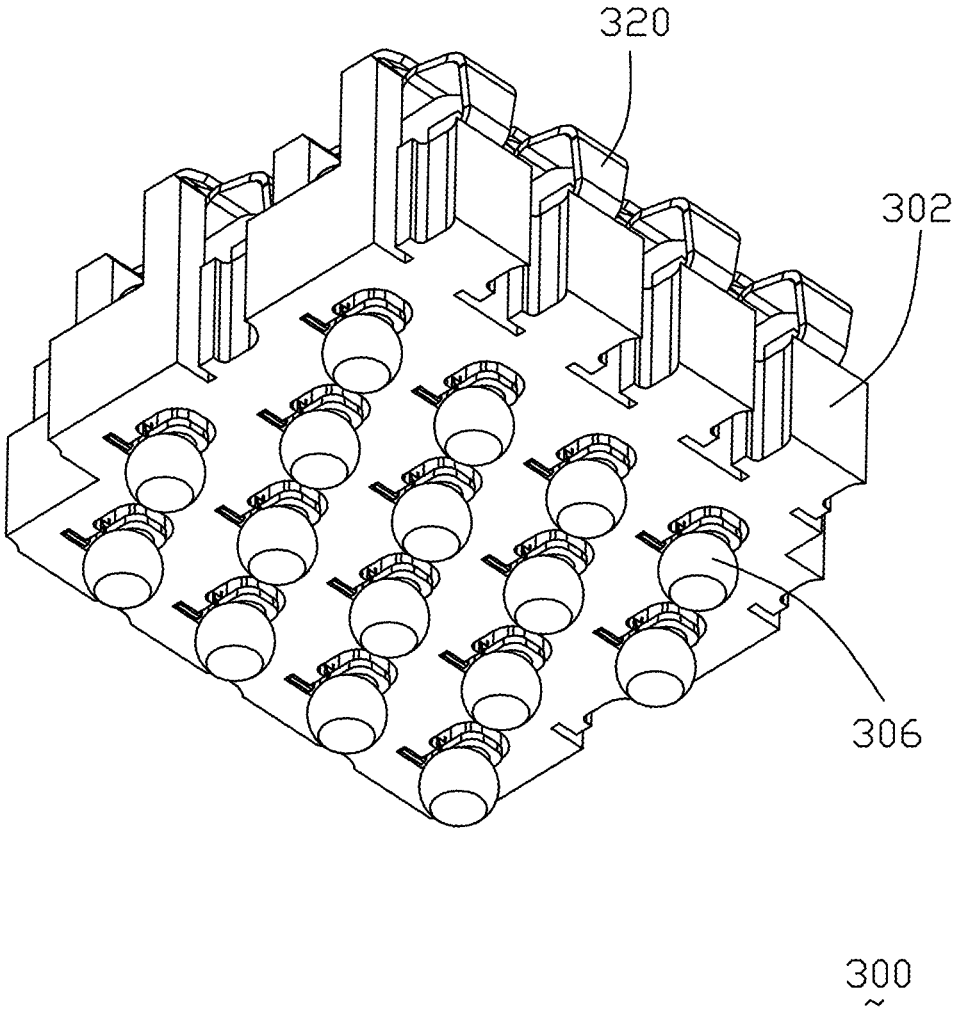
FIG. 9(B) is an upward perspective view of the electrical connector of FIG. 9(A)
Figure 10A:
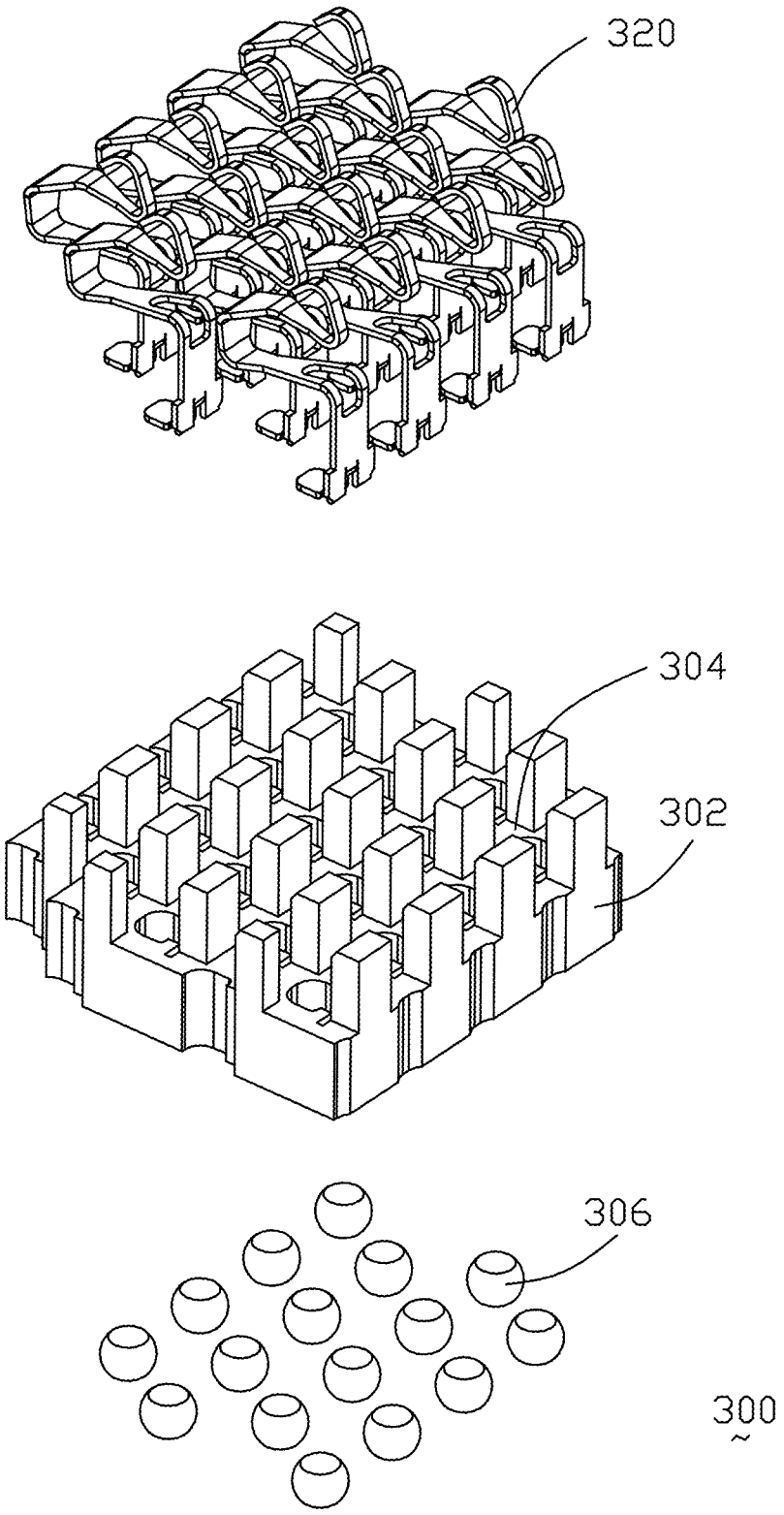
FIG. 10(A) is an downward exploded perspective view of the electrical connector of FIG. 9(A)
Figure 10B:
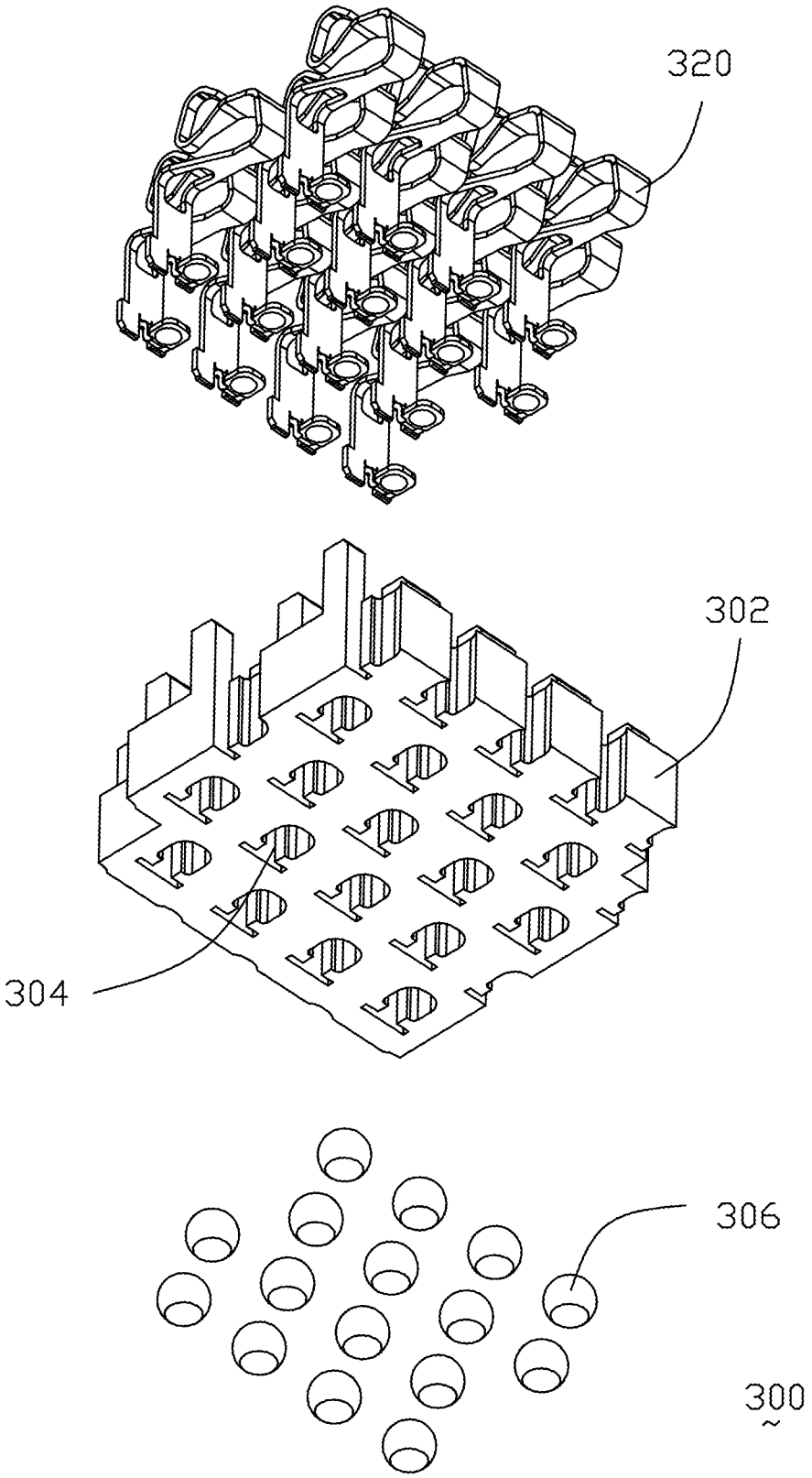
FIG. 10(B) is an upward exploded perspective view of the electrical connector of FIG. 9(B)
Figure 11A:
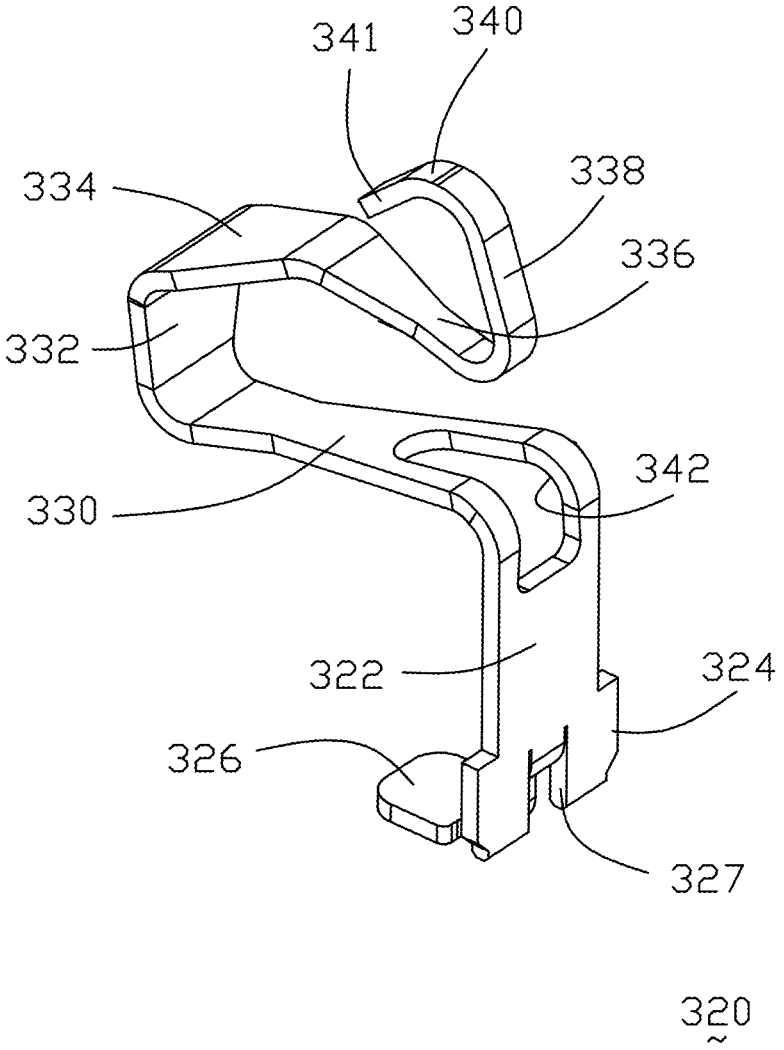
FIG. 11(A) is a downward perspective view of the contact of the electrical connector of FIG. 9(A)
Figure 11B:
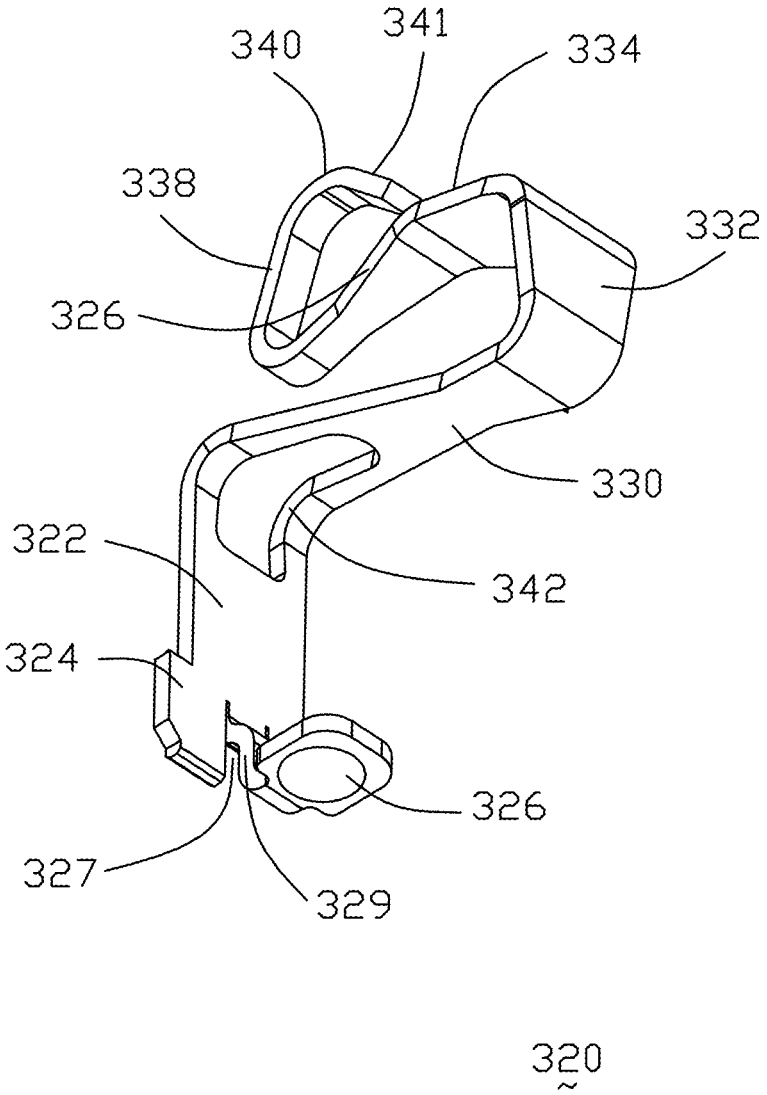
FIG. 11(B) is an upward perspective view of the contact of the electrical connector of FIG. 9(B)
Figure 12A:
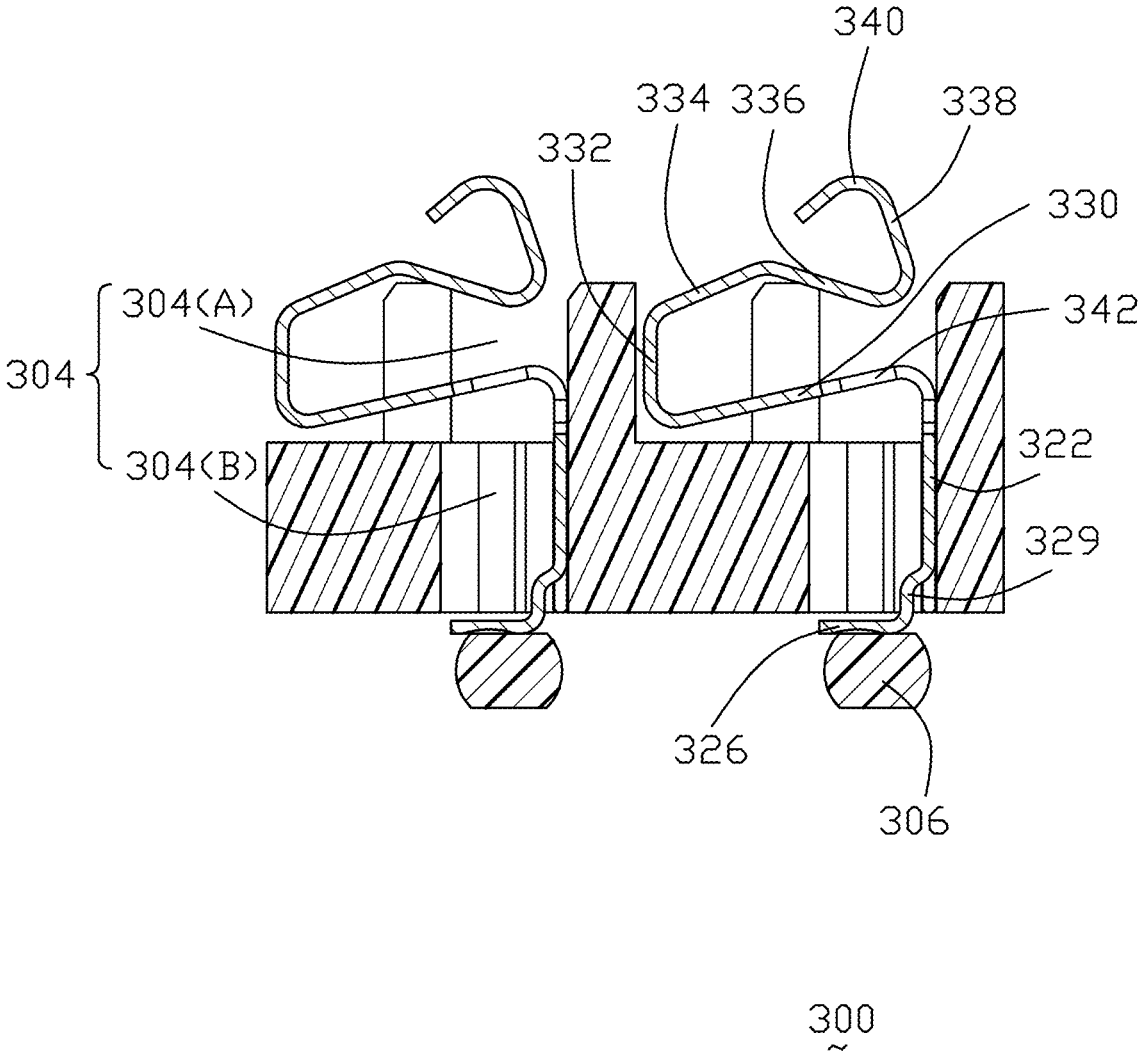
FIG. 12(A) is cross-sectional view of the electrical connector of FIG. 9(A) when the contact is not downwardly pressed by the CPU and soldered upon the PCB.
Figure 12B:
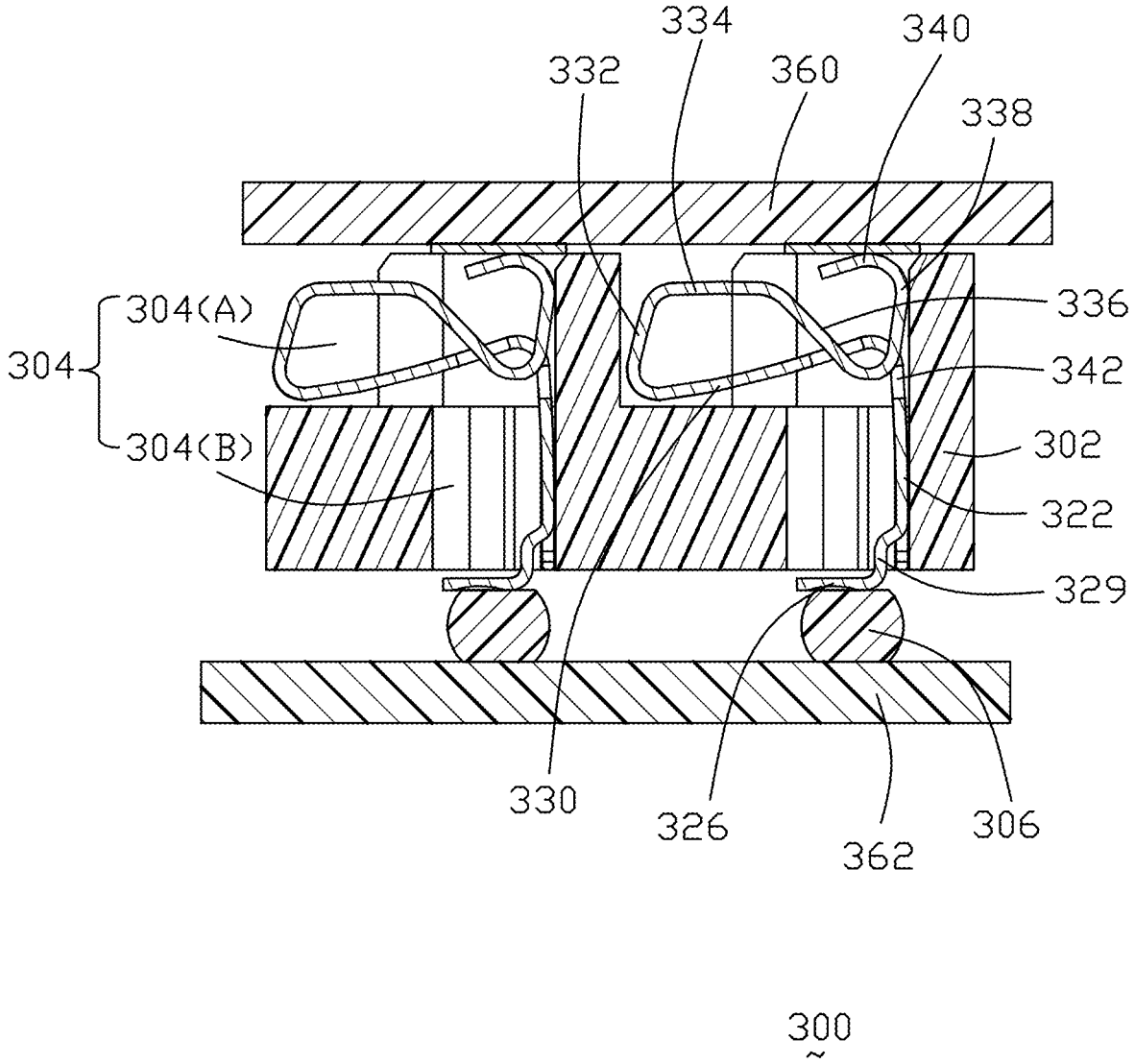
FIG. 12(B) is another cross-sectional view of the electrical connector of FIG. 9(A) when the connector is connected with both the CPU and the PCB and the contact is downwardly pressed.
Figure 13A:
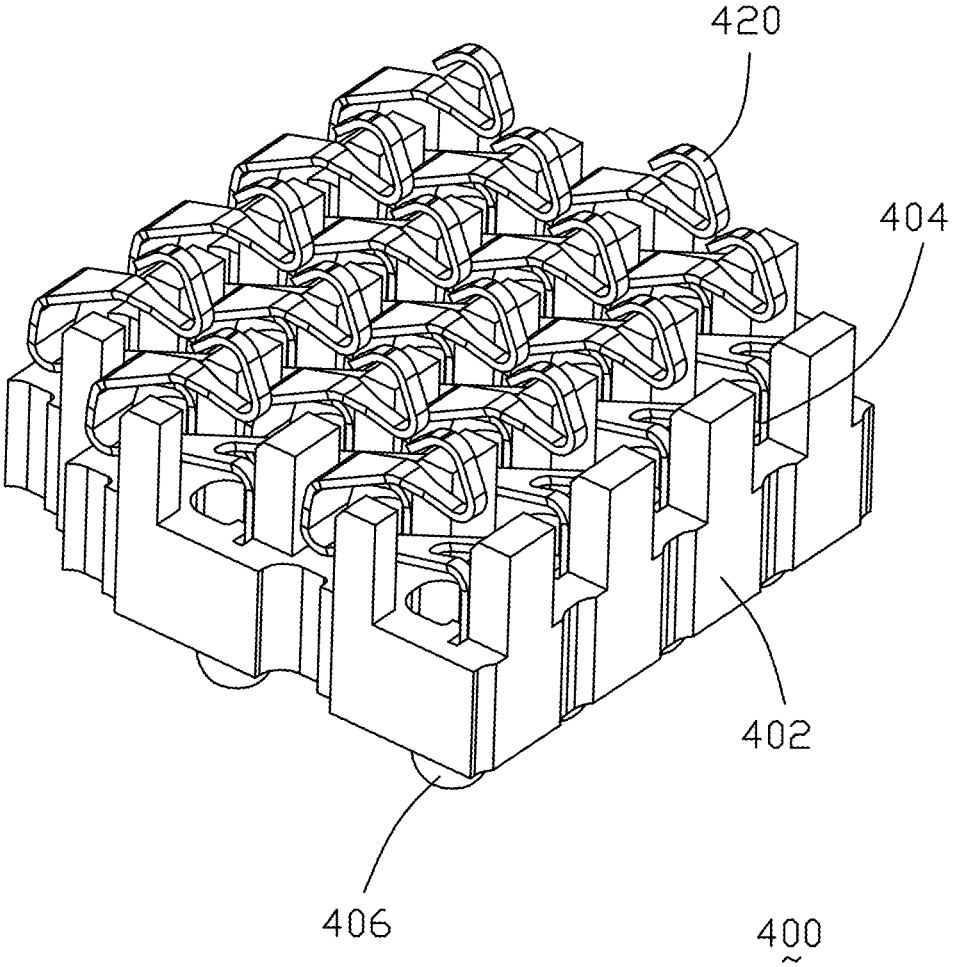
FIG. 13(A) is a downward perspective view of an electrical connector according to a fourth embodiment of the invention.
Figure 13B:
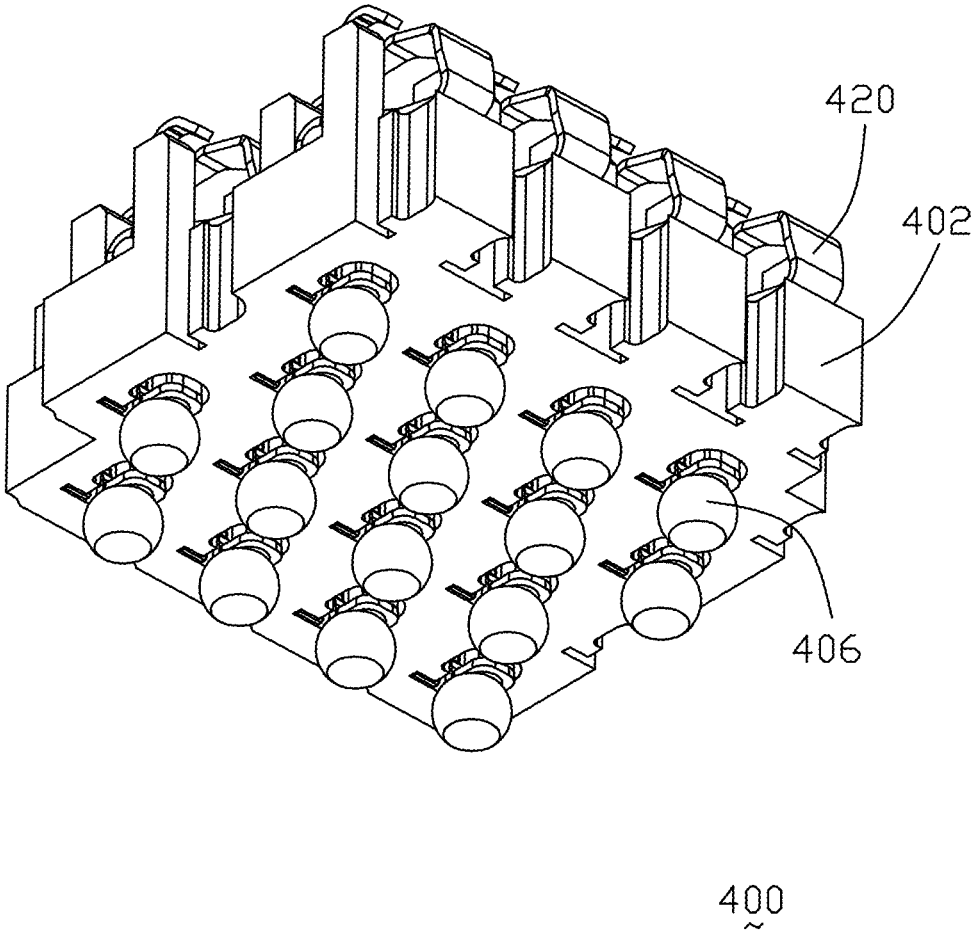
FIG. 13(B) is an upward perspective view of the electrical connector of FIG. 13(A)
Figure 14A:
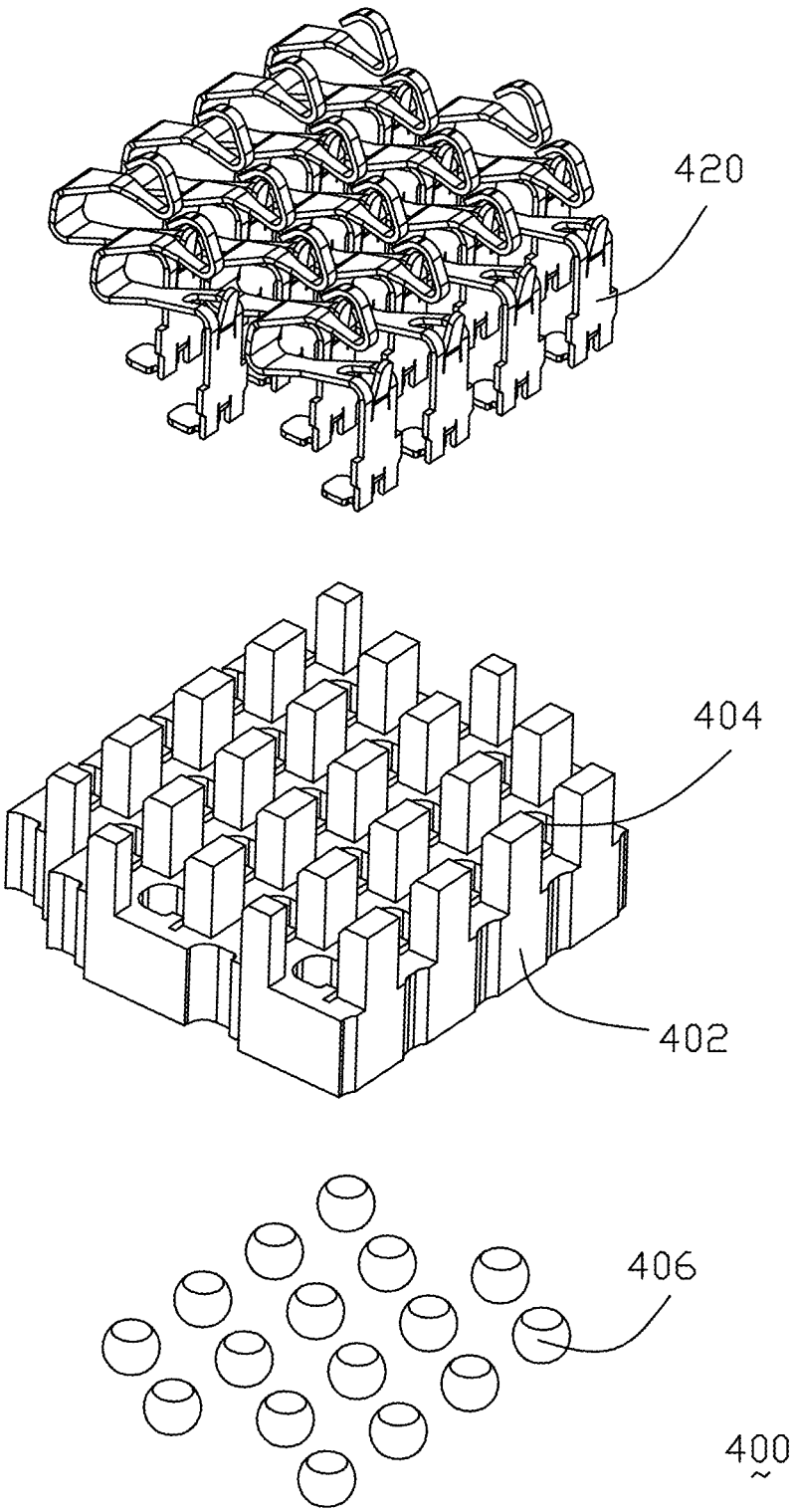
FIG. 14(A) is an downward exploded perspective view of the electrical connector of FIG. 13(A)
Figure 14B:
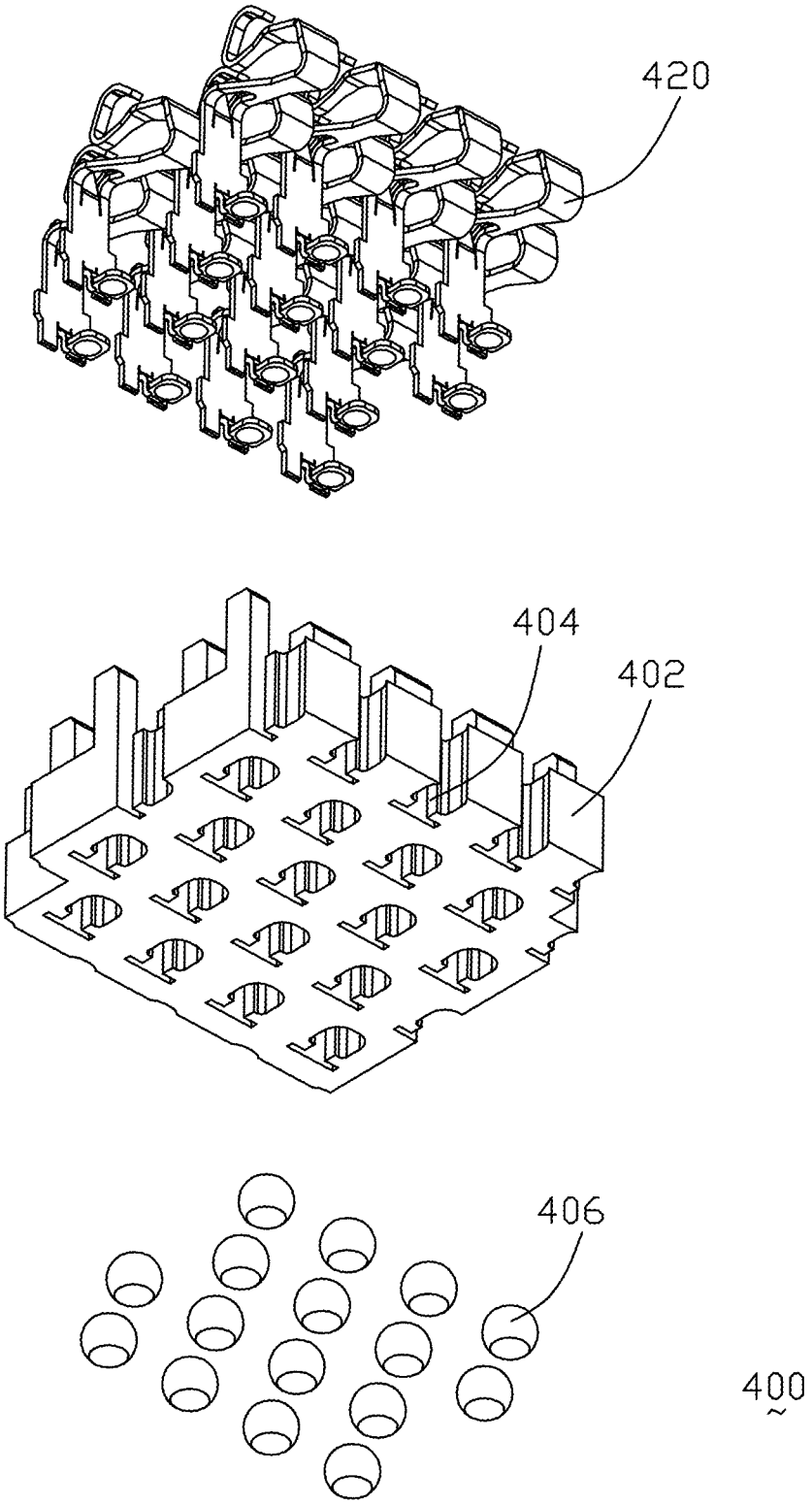
FIG. 14(B) is an upward exploded perspective view of the electrical connector of FIG. 13(B)
Figure 15A:
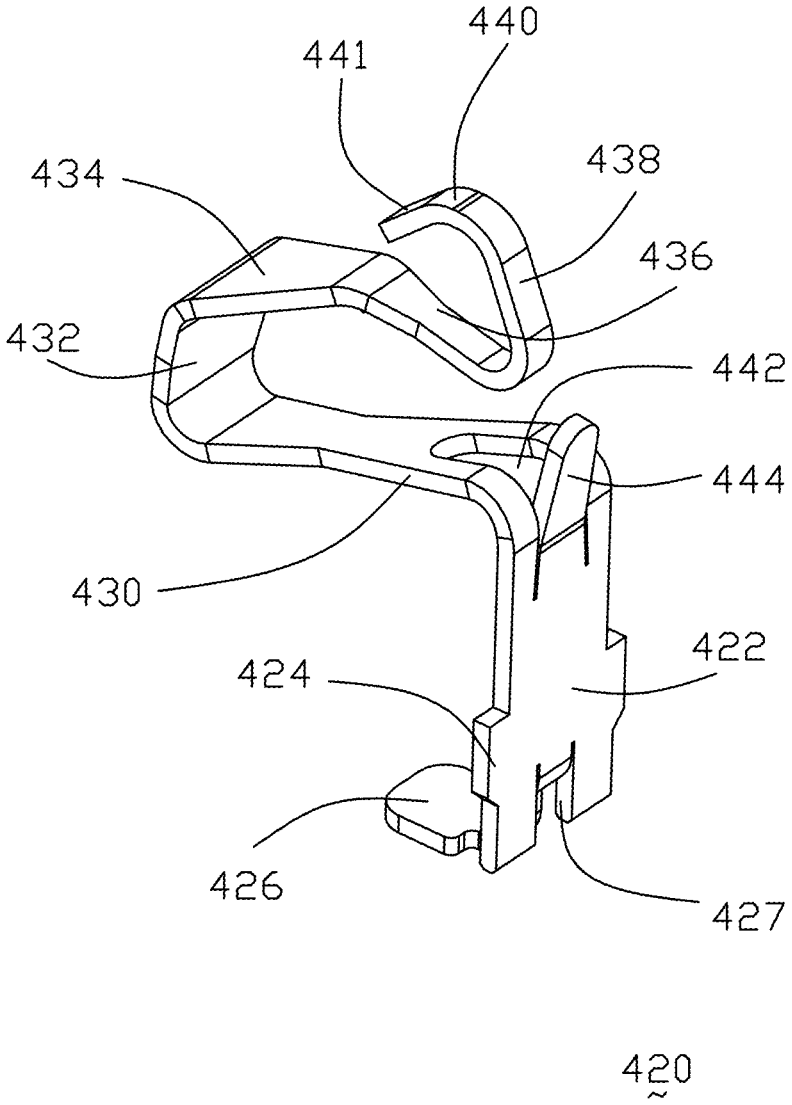
FIG. 15(A) is a downward perspective view of the contact of the electrical connector of FIG. 13(A)
Figure 15B:
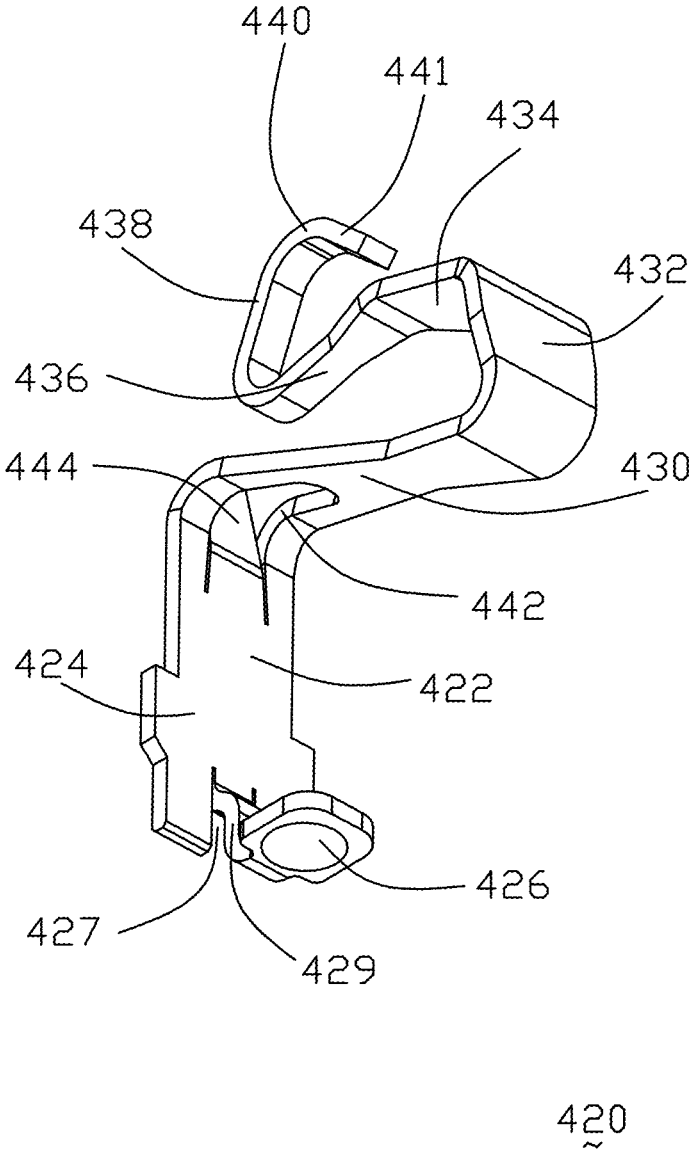
FIG. 15(B) is an upward perspective view of the contact of the electrical connector of FIG. 13(B)
Figure 16A:
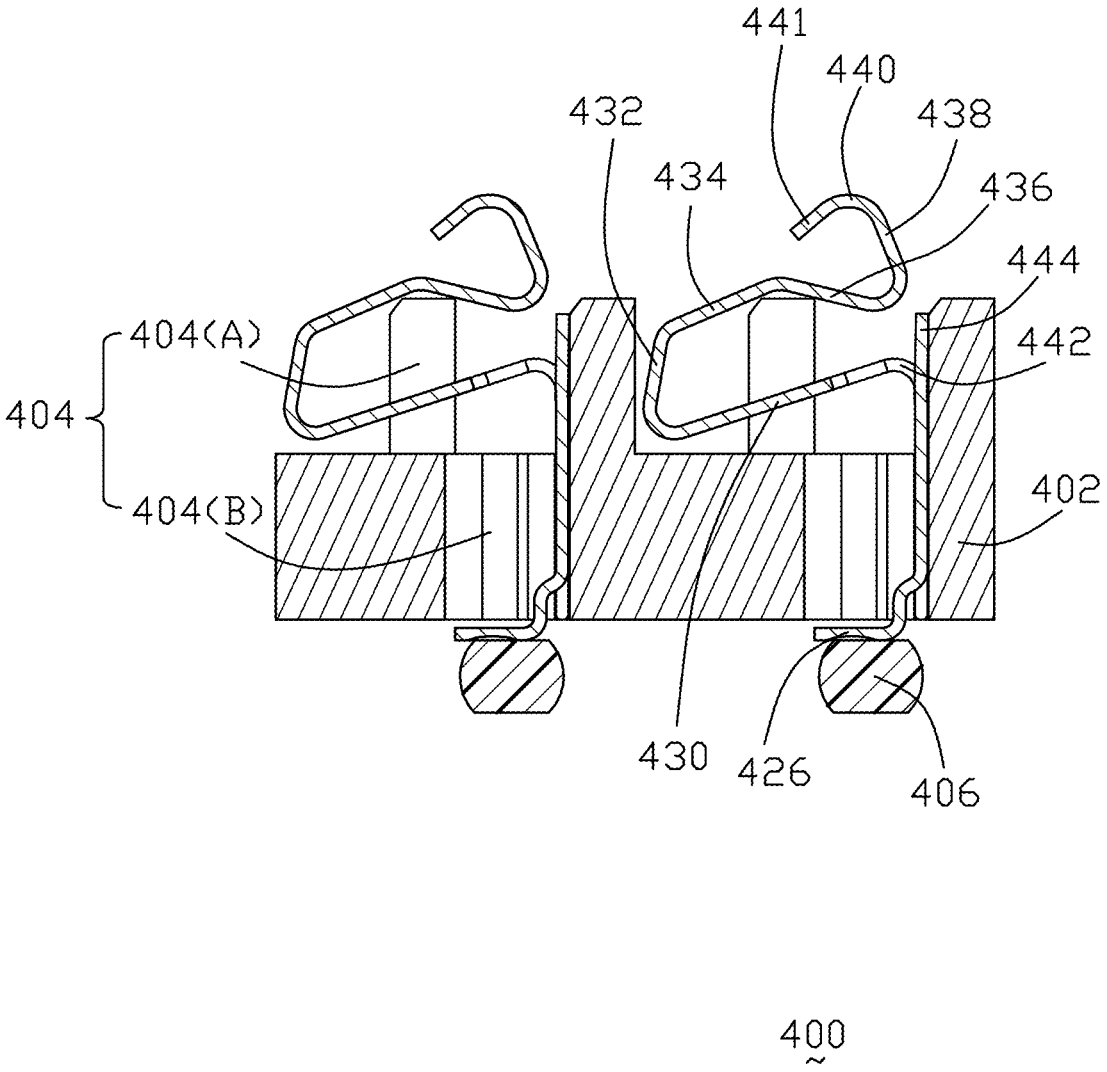
FIG. 16(A) is cross-sectional view of the electrical connector of FIG. 13(A) when the contact is not downwardly pressed by the CPU and soldered upon the PCB.
Figure 16B:
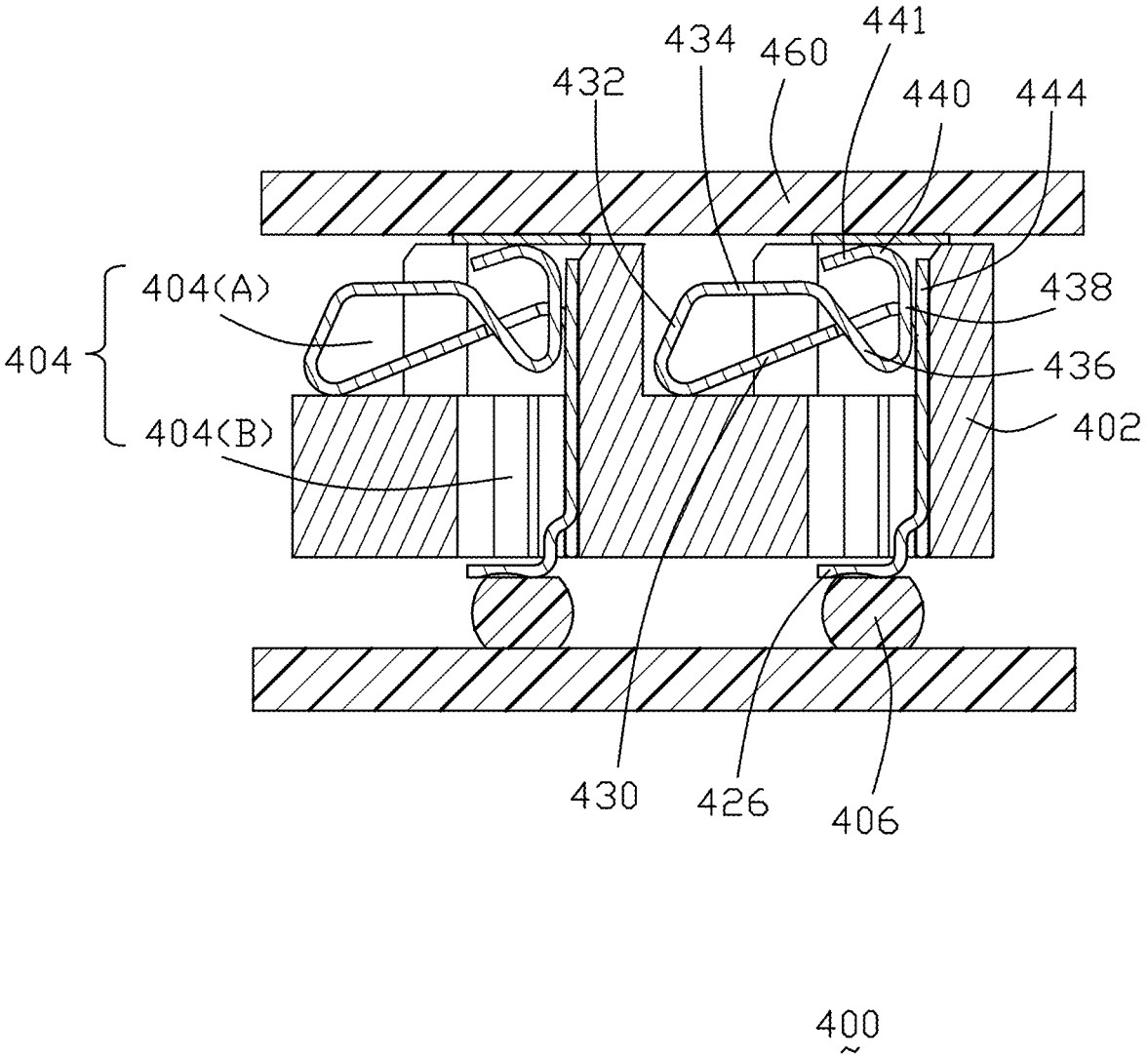
FIG. 16(B) is another cross-sectional view of the electrical connector of FIG. 1(A) when the connector is connected with both the CPU and the PCB and the contact is downwardly pressed.

Referring to FIGS. 1(A)-4(B), an electrical connector 100 includes an insulative housing 102 with a plurality of passageways 104 to retain a plurality of contacts 120 therein. Each contact 120 includes a main body 122 extending in a vertical plane with a pair of retaining structure 124 on two opposite lateral sides. A mounting section 126 is formed at a bottom portion of the main body 120 by splitting to form an opening 127 with an offset section 129 and a horizontal solder pad to which the solder ball 106 is attached on the undersurface. A first transverse section 130 extends from an upper portion of the main body 122 in a first transverse direction, an upward section 132 extends from an end of the first transverse direction 130, a second transverse section 134 extends from an upper end of the upward section 132 in a second transverse direction opposite to the first transverse direction, and a curved or upward bulged contacting section 136 is formed at a free end of the second transverse section 134 with a downward tip section 140. A slot 138 extends through the first transverse direction 130, the upward section 132 and the second transverse section 134 for enhancing resiliency thereof. Notably, the main body 122 abuts against an interior surface of the housing in the passageway 104. The passageway 104 is composed of the lower small part 204(B) receiving the main body 122, and the upper large part 204(A) receiving the first transverse section 130 and the upward section 132.

Referring to FIGS. 5(A)-8(B), an electrical connector 200 includes an insulative housing 202 with a plurality of passageways 204 to retain a plurality of contacts 220 therein. Each of the contacts 220 includes a main body 222 extending in a vertical plane with a pair of retaining structure 224 on two opposite lateral sides. A mounting section 226 is split from a bottom portion of the main body 222 with an offset section 229 in an opening 227 and a horizontal solder pad to which a solder ball 206 is attached to an undersurface thereof. A first transverse section 230 extends from an upper portion of the main body 222 in a first transverse direction, a curved or U-shaped upward section 232 extends from an end of the first transverse section 230 in a first transverse direction, and second transverse section 234 extends from the upward section 232 in a second transverse direction opposite to the first transverse direction, another upward section 236 extends from an end of the second transverse section 234, a third transverse section 238 extends from the another upward section 236 in a third transverse direction which is same with the first transverse direction, and a curved contacting section 240 is formed at a free end of the third transverse section 238 with a downward tip 241. A slot 242 is formed in the first transverse section 230, the upward section 232 and the second transverse section 234. During mating with the CPU, the contact 220 is downwardly by the CPU with the tip 242 received within the slot 242. The passageway 204 includes a lower small part 204(B) to receive the main body 222 and an upper large part 204(A) to receive the first transverse section 230, the upward section 230, the second transverse section 234, the another upward section 236 and the third transverse section 238.

Referring to FIGS. 9(A)-12(B), an electrical connector 300 includes an insulative housing 302 with a plurality of passageways 304 retaining a plurality of contacts 320 therein. Each of the contacts 320 includes a main body 322 with a pair of retaining structures 324 on two opposite lateral sides. A mounting section 326 is split from the bottom portion of the main body 322 with an offset section 329 in an opening 327 and a solder pad to which a solder ball 306 is attached to an undersurface thereof. A first transverse section 330 extends from an upper portion of the main body 322 in a first transverse direction, an upward section 332 extends from an end of the first transverse section 330, and a second transverse section 334 extends from an upper end of the upward section 332 in a second transverse direction opposite to the first transverse direction. A third transverse section 336 further extends from a free end of the second transverse section 334 along the third transverse direction same with the second transverse direction, and downward toward the main body 322. In other words, the second transverse section 334 and the third transverse section 336 may be commonly deemed as one deflected or angled transverse direction with an apex at a middle region thereof. A fourth transverse section 338 extends from an end of the third transverse section 336 in a fourth transverse direction same with the first transverse direction. A curved contacting section 340 is formed at an end of the fourth transverse section 338 with downward tip 341. In this embodiment, the fourth transverse section 338 may be deemed as a lower portion of the contacting section 340 during operation. A slot 342 is formed in a joint region between the main body 322 and the first transverse section 330. During mating, an joint between the third transverse section 336 and the fourth transverse section 338 is received within the slot 342. The passageway 304 includes lower small part 304(B) to receive the main body 322 and an upper large part 304(A) to receive the first transverse section 330 and the upward section 332.

Referring to FIGS. 13(A)-16(B), the electrical connector 400 is very similar to the third connector 300 including the housing 402, the passageways 404, the solder ball 406 and the contact 420. Each contact 420 has the main body 422, the retaining structures 424, the offset section 429, the mounting section 426, the opening 427, the first transverse section 430, the upward section 432, the second transverse section 434, the third transverse section 436, the fourth transverse section 438, the contacting section 440, the tip 441 and the slot 442. The passageway 404 includes a lower small part 404(B) and a large upper part 404(A). The exception is that in the contact 420, an additional abutment tab 444 split from the slot 442, extends upward to abut against an interior surface of the housing 402 in the upper large part 404(A) to confront the fourth transverse section 438 intimately.

Figure 17:
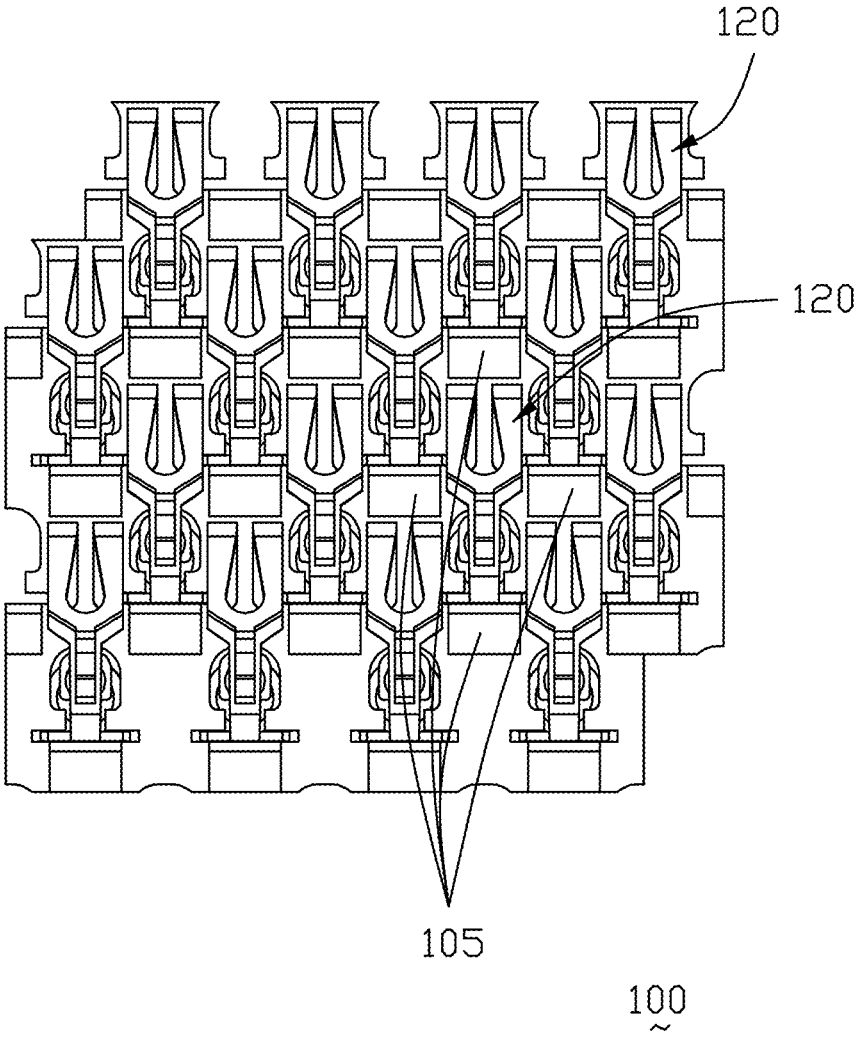
FIG. 17 is a top view of the electrical connector of FIG. 1.
Figure 18:
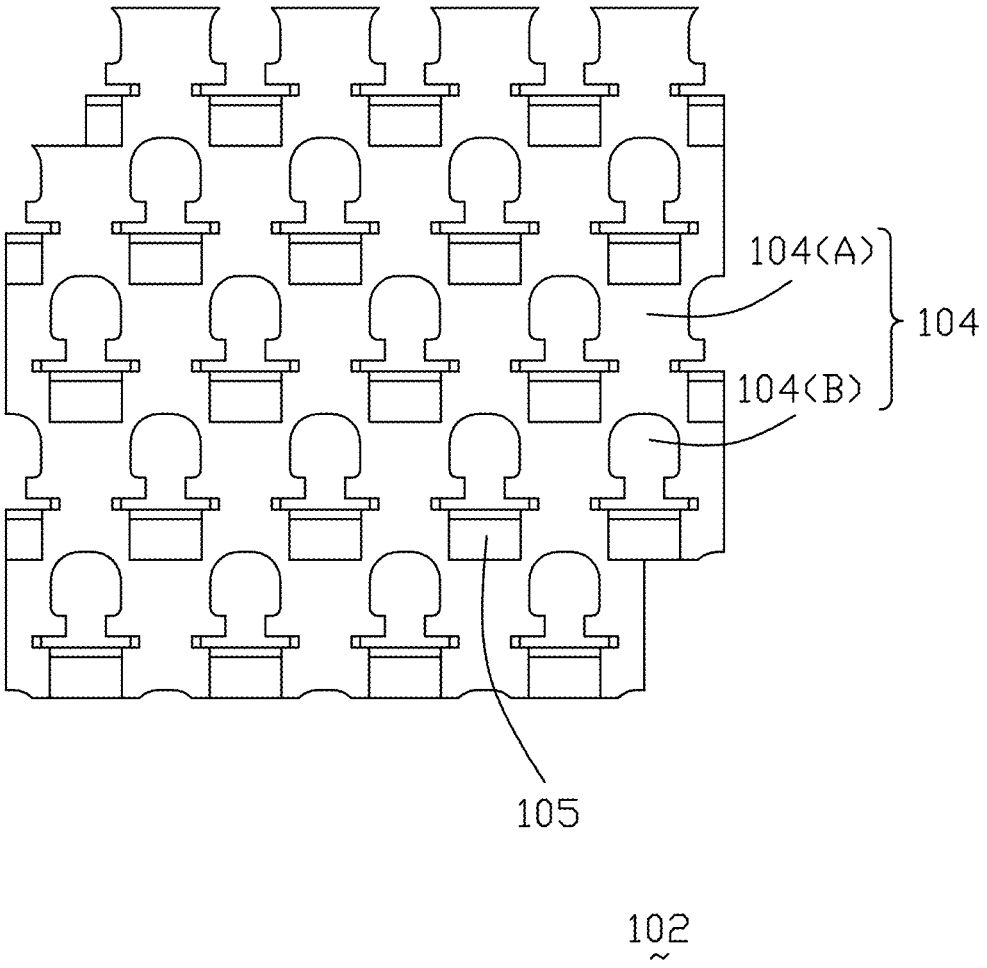
FIG. 18 is a top view of the housing of the electrical connector of FIG. 1.
Figure 19:
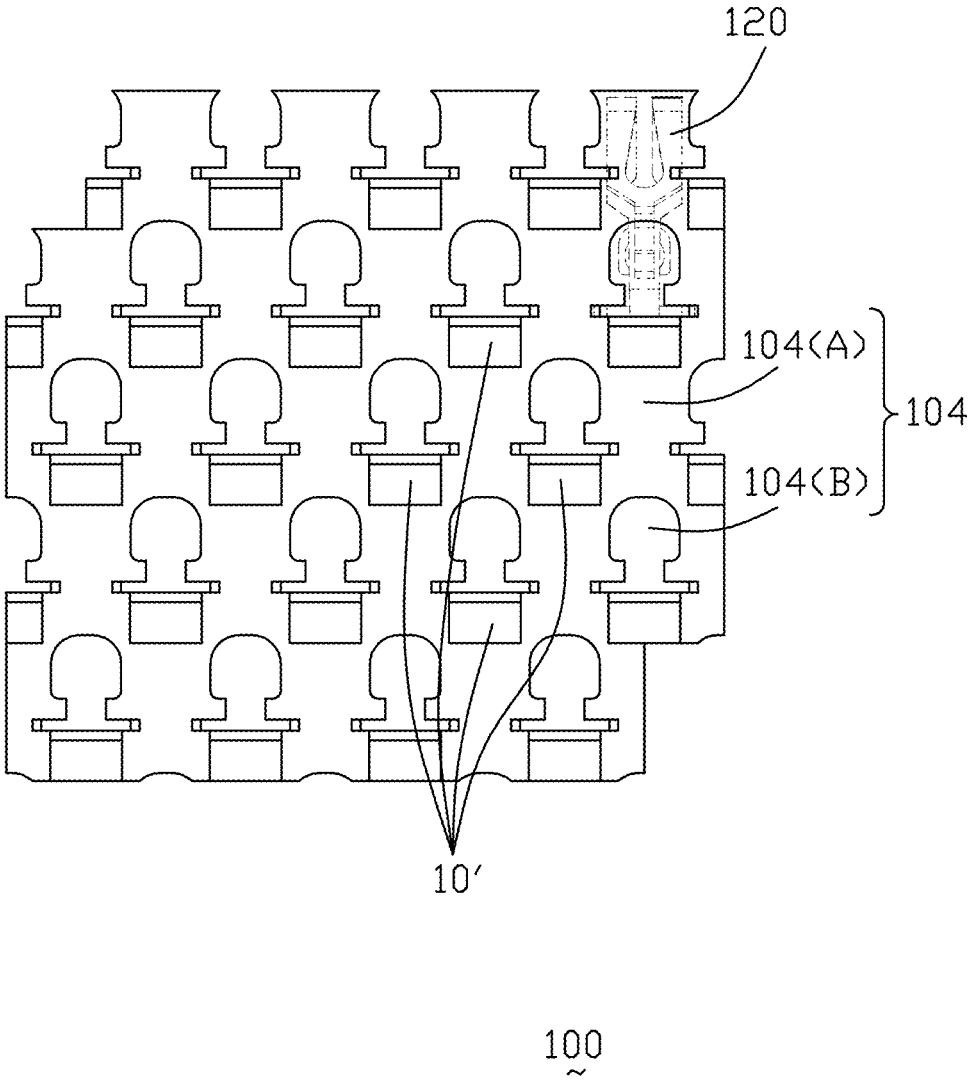
FIG. 19 is a top view of the housing of the electrical connector of FIG. 1 with one contact shown in the dashed line.
Figure 20:
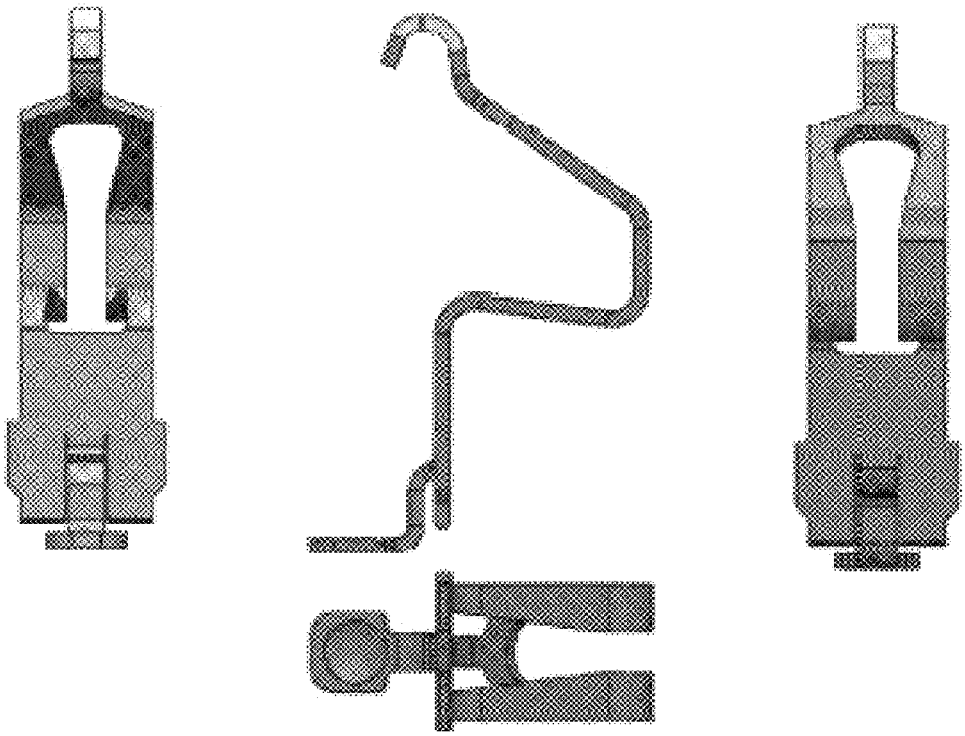
FIG. 20 shows the fifth embodiment of the invention.

Referring to FIGS. 17-19, in the invention the upper large part 104(A) is formed by four upwardly extending posts 105 which are arranged in a diamond shape beneficial for heat dissipation and contact extending configuration/dimension consideration, and the passageway 104 is offset from a half pitch with regard to that in the neighboring row either in direction X or direction Y. From another viewpoint, the Such a dense and even arrangement may have the forces evenly applied to the whole housing. Generally speaking, the post 105 may by regarded as the standoffs extending from a seating plane which is a boundary/interface between the upper large part 104(A) and the lower small part 104(B). FIG. 20 shows another embodiment similar to the foregoing embodiments.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the members in which the appended claims are expressed.

What is claimed is:

1. An electrical connector for receptive use with an electronic package, comprising:

an insulative housing and a plurality of contacts retained in the housing; each of the contacts including a vertical main body with a retaining structure thereon, a mounting section split from a bottom portion of the main body with a horizontal pad at the end, a first transverse section extending from a top portion of the main body in a first transverse direction, an upward section extending upward from one end of the first transverse section, a second transverse section extending from an upper end of the upward section in a second transverse direction opposite to the first transverse direction, a contacting section extending from an end of the second transverse section and defining a curved configuration thereof, and a downward tip section formed at a free end of the contact section; wherein the contact section forms a contacting point which is aligned with the horizontal pad in the vertical direction when the contacting section is downwardly deflected by the corresponding electronic package; wherein a slot is formed in at least the first transverse section or further the upward section for receiving a portion of the contact when said contacting section is downwardly deflected by the electronic package; wherein a vertical line defined between the contacting point and the horizontal pad passes both the first transverse section and the second transverse section.

2. The electrical connector as claimed in claim 1, wherein the slot extends downwardly into the main body.

3. The electrical connector as claimed in claim 2, wherein the main body forms an upwardly extending abutment tab within the slot to intimately confront a lower portion of the contacting section when the contacting section is downwardly deflected by the electronic package.

4. The electrical connector as claimed in claim 1, wherein said free end of the contacting section is received within the slot when the contacting section is downwardly deflected by the electronic package.

5. The electronic connector as claimed in claim 1, wherein a joint between the contacting section and the second transverse section is received within the slot when the contacting section is downwardly deflected by the electronic package.

6. The electrical connector as claimed in claim 1, wherein the horizontal pad extends from the bottom portion of the main body in the first transverse direction.

7. The electrical connector as claimed in claim 6, wherein the second transverse section forms a deflected and angled structure with an apex at a middle region thereof.

8. The electrical connector as claimed in claim 1, wherein the main body forms a retention structure for retaining the contact in the housing.

9. The electrical connector as claimed in claim 1, wherein an opening is formed between the main body and an offset section which is linked between the main body and the horizontal pad.

10. The electrical connector as claimed in claim 1, wherein a slot is formed in both the first transverse section, the second transverse section and the upward section therebetween.

11. The electrical connector as claimed in claim 1, wherein the free end of the contacting section extends in the first transverse direction.

12. The electrical connector as claimed in claim 1, wherein the free end of the contacting section extends in the second transverse direction.

13. The electrical connector as claimed in claim 1, wherein the horizontal pad extends in the second transverse direction.

14. The electrical connector as claimed in claim 13, wherein the first transverse section indirectly extends from the top portion of the main body via a third transverse section and an upward section therebetween, the third transverse section extending directly from a top end of the main body in the transverse direction and the upward section extending upwardly from the third transverse direction and linked to the first transverse section.

15. An electrical connector for receptive use with an electronic package, comprising:

an insulative housing and a plurality of contacts retained in the housing; each of the contacts including a vertical main body with a retaining structure thereon, a mounting section split from a bottom portion of the main body with a horizontal pad at the end, a first transverse section extending from a top portion of the main body in a first transverse direction, an upward section extending upward from one end of the first transverse section, a second transverse section extending from an upper end of the upward section in a second transverse direction opposite to the first transverse direction, a contacting section extending from an end of the second transverse section and defining a curved configuration thereof, and a downward tip section formed at a free end of the contact section; wherein the contact section forms a contacting point which is aligned with the horizontal pad in the vertical direction when the contacting section is downwardly deflected by the corresponding electronic package; wherein a slot is formed in at least the first transverse section or further the upward section for receiving a portion of the contact when said contacting section is downwardly deflected by the electronic package; wherein the slot extends downwardly into the main body; wherein the main body forms an upwardly extending abutment tab within the slot to intimately confront a lower portion of the contacting section when the contacting section is downwardly deflected by the electronic package.

16. An electrical connector for receptive use with an electronic package, comprising:

an insulative housing and a plurality of contacts retained in the housing; each of the contacts including a vertical main body with a retaining structure thereon, a mounting section split from a bottom portion of the main body with a horizontal pad at the end, a first transverse section extending from a top portion of the main body in a first transverse direction, an upward section extending upward from one end of the first transverse section, a second transverse section extending from an upper end of the upward section in a second transverse direction opposite to the first transverse direction, a contacting section extending from an end of the second transverse section and defining a curved configuration thereof, and a downward tip section formed at a free end of the contact section; wherein the contact section forms a contacting point which is aligned with the horizontal pad in the vertical direction when the contacting section is downwardly deflected by the corresponding electronic package; wherein a slot is formed in at least the first transverse section or further the upward section for receiving a portion of the contact when said contacting section is downwardly deflected by the electronic package; wherein a joint between the contacting section and the second transverse section is received within the slot when the contacting section is downwardly deflected by the electronic package.

* * * * *